US010665386B2

(12) United States Patent
Hirabayashi et al.

(10) Patent No.: US 10,665,386 B2
(45) Date of Patent: May 26, 2020

(54) REACTOR AND REACTOR MANUFACTURING METHOD

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tatsuo Hirabayashi, Mie (JP); Masayuki Kato, Mie (JP); Takashi Misaki, Mie (JP); Seiji Shitama, Mie (JP); Shinichiro Yamamoto, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-Shi, Osaka (JP)

( * ) Notice: Subject to any disclaimer, the term of this patent is extended or adjusted under 35 U.S.C. 154(b) by 98 days.

(21) Appl. No.: 15/779,692

(22) PCT Filed: Jan. 26, 2017

(86) PCT No.: PCT/JP2017/002828
§ 371 (c)(1),
(2) Date: May 29, 2018

(87) PCT Pub. No.: WO2017/131123
PCT Pub. Date: Aug. 3, 2017

(65) Prior Publication Data

US 2019/0259532 A1 Aug. 22, 2019

(30) Foreign Application Priority Data

Jan. 29, 2016 (JP) ..... 2016-016035

(51) Int. Cl.
*H01F 3/14* (2006.01)
*H01F 41/02* (2006.01)
(Continued)

(52) U.S. Cl.
CPC ..... *H01F 41/0246* (2013.01); *H01F 3/14* (2013.01); *H01F 27/02* (2013.01); *H01F 27/022* (2013.01);
(Continued)

(58) Field of Classification Search
CPC ..... H01F 41/0246; H01F 41/127; H01F 27/2823; H01F 27/32; H01F 27/02;
(Continued)

(56) References Cited

U.S. PATENT DOCUMENTS

2011/0234359 A1* 9/2011 Ono ..... H01F 27/306 336/216
2014/0175867 A1* 6/2014 Sung ..... F16H 57/0412 307/9.1
(Continued)

FOREIGN PATENT DOCUMENTS

JP 2014-143332 A 8/2014
JP 2015-005579 A 1/2015
JP 2015-188019 A 10/2015

OTHER PUBLICATIONS

Search Report for PCT/JP2017/002828, dated Apr. 25, 2017.

*Primary Examiner* — Mang Tin Bik Lian
(74) *Attorney, Agent, or Firm* — Honigman LLP

(57) ABSTRACT

A reactor including: a coil that includes a winding portion; a magnetic core that includes a plurality of core pieces that are located inside and outside the winding portion; an interposed member that is interposed between the coil and the magnetic core; and a resin mold portion that includes an outer covering portion that covers at least a portion of an
(Continued)

outer core piece of the magnetic core, the outer core piece being located outside the winding portion. The interposed member includes an outer interposed portion that is interposed between an end surface of the winding portion and an inner end surface of the outer core piece, and the outer interposed portion has a hole on the outer core piece side, through which a portion of the inner end surface of the outer core piece is exposed from the resin mold portion.

5 Claims, 6 Drawing Sheets

(51) Int. Cl.

| | |
|---|---|
| ***H01F 27/02*** | (2006.01) |
| ***H01F 27/24*** | (2006.01) |
| ***H01F 27/28*** | (2006.01) |
| ***H01F 27/32*** | (2006.01) |
| ***H01F 41/12*** | (2006.01) |
| ***H01F 37/00*** | (2006.01) |

(52) U.S. Cl.
CPC ..... *H01F 27/24* (2013.01); *H01F 27/2823* (2013.01); *H01F 27/32* (2013.01); *H01F 37/00* (2013.01); *H01F 41/127* (2013.01)

(58) Field of Classification Search
CPC ..... H01F 27/24; H01F 27/022; H01F 3/14; H01F 37/00
USPC ..... 336/212, 208, 178; 29/602.1, 605, 606
See application file for complete search history.

(56) References Cited

U.S. PATENT DOCUMENTS

2014/0292456 A1 10/2014 Suzuki et al.
2015/0130576 A1* 5/2015 Suzuki ..... H01F 27/00 336/92
2015/0162119 A1* 6/2015 Nakatsu ..... H01F 27/306 336/105
2015/0279550 A1 10/2015 Kitami et al.

* cited by examiner

10:2, 3, 5
3:31, 32, 60
51:510, 515

51 : 510, 515

REACTOR AND REACTOR MANUFACTURING METHOD

CROSS-REFERENCE TO RELATED APPLICATIONS

This application is the U.S. national stage of PCT/JP2017/002828 filed Jan. 26, 2017, which claims priority of Japanese Patent Application No. 2016-016035 filed on Jan. 29, 2016, which is incorporated herein by reference in its entirety.

FIELD OF THE INVENTION

The present description relates to a reactor and a reactor manufacturing method.

BACKGROUND OF THE INVENTION

A reactor is one type of circuit component that performs a voltage step-up operation or step-down operation. JP 2012-248904A discloses, as a reactor for an on-board converter, a reactor that includes: a coil that includes a pair of winding portions that are formed by spirally winding a winding wire; a ring-shaped magnetic core that is provided inside and outside the winding portions; tubular bobbins that are interposed between the winding portions and the magnetic core; and a B-shaped frame bobbin.

The above-described magnetic core includes a plurality of core pieces and gap plates that are made of alumina or the like and are each interposed between core pieces that are adjacent to each other. Portions of the above-described magnetic core located inside the winding portions are stacked objects in which an intermediate core piece (corresponding to an inner core piece) and a gap plate are stacked one after the other and that are fixed using an adhesive. The above-described tubular bobbins are interposed between the inner circumferential surfaces of the winding portions and the stacked objects. The frame bobbin is interposed between end surfaces of the winding portions and end portion core pieces (corresponding to outer core pieces) that are located outside the winding portions, and is provided with a pair of through holes through which the stacked objects are respectively inserted. End surfaces of the intermediate core pieces exposed from the through holes and inner end surfaces of end portion core pieces are joined to each other using an adhesive. JP 2012-248904A discloses, for example, achieving mechanical protection using resin to cover a combined body that includes the above-described coil, the above-described magnetic core, the tubular bobbins, and the frame bobbin.

SUMMARY OF THE INVENTION

A reactor according to the present disclosure includes: a coil that includes a winding portion; a magnetic core that includes a plurality of core pieces that are located inside and outside the winding portion; an interposed member that is interposed between the coil and the magnetic core; and a resin mold portion that includes an outer covering portion that covers at least a portion of an outer core piece of the magnetic core, the outer core piece being located outside the winding portion. The interposed member includes an outer interposed portion that is interposed between an end surface of the winding portion and an inner end surface of the outer core piece, and the outer interposed portion has a hole on the outer core piece side, through which a portion of the inner end surface of the outer core piece is exposed from the resin mold portion.

A reactor manufacturing method according to the present disclosure includes: a step of putting a combined body into a mold, and forming a resin mold portion, the combined body including: a coil that includes a winding portion; a magnetic core that includes a plurality of core pieces that are located inside and outside the winding portion; and an interposed member that is interposed between the coil and the magnetic core, and the resin mold portion covering at least a portion of an outer core piece of the magnetic core, the outer core piece being located outside the winding portion. The interposed member includes an outer interposed portion that is interposed between an end surface of the winding portion and an inner end surface of the outer core piece, and the outer interposed portion has a hole on the outer core piece side, through which a portion of the inner end surface of the outer core piece is exposed, and the resin mold portion is formed in a state where a pin that protrudes from an inner surface of the mold is inserted into the hole so that a portion of the inner end surface is supported.

DETAILED DESCRIPTION OF THE PREFERRED EMBODIMENTS

Figure 1:
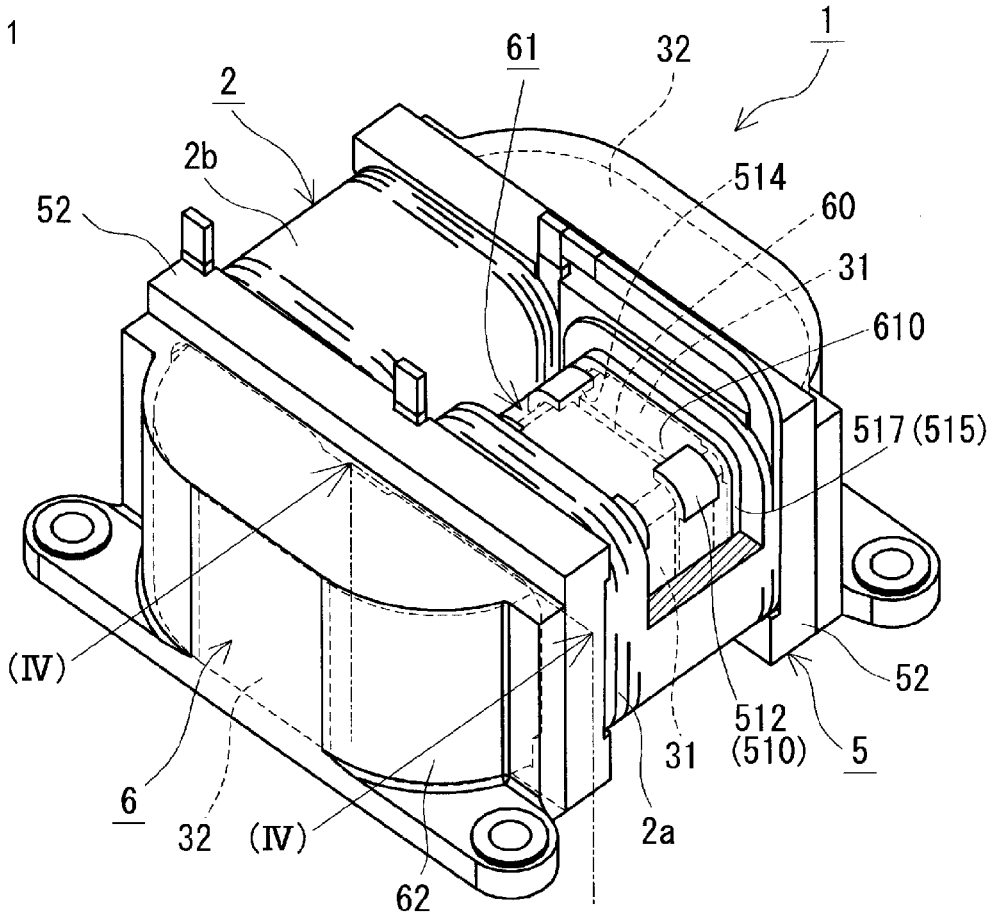
FIG. 1 is a schematic perspective view showing a reactor according to a first embodiment.

When manufacturing a reactor in which at least a portion of a magnetic core that includes a plurality of core pieces is covered by resin, it is desirable that the magnetic core is unlikely to be displaced relative to a mold that is used for molding resin.

For example, it is assumed that a combined body that includes: the above-described coil; a plurality of core pieces; a tubular bobbin; and a frame bobbin is housed in a mold, the mold is filled with material resin, and at least an outer core piece is covered. When the outer core piece is housed in the mold and the mold is filled with material resin, the outer core piece is subjected to a pressure in a filling direction from the material resin. If the filling pressure increases, the above-described pressure also increases, and there is the risk of the outer core piece being displaced relative to the mold. The risk of the outer core piece being displaced relative to the mold also depends on the filling direction. Due to such displacement, the three elements, namely the outer core piece, the inner core piece, and the coil, will not be located at appropriate positions, which may result in degradation of the properties of the reactor. Thus, to manufacture a reactor that is reliably provided with predetermined properties, it is desirable that the above-described displacement can be prevented.

Therefore, one objective is to provide a reactor and a reactor manufacturing method with which the magnetic core is unlikely to be displaced relative to a mold when a resin mold portion is molded.

With the above-described reactor and the above-described reactor manufacturing method, the magnetic core is unlikely to be displaced relative to the mold when the resin mold portion is molded.

First, the following lists up and describes embodiments of the present description.

(1) A reactor according to one aspect of the present description includes: a coil that includes a winding portion; a magnetic core that includes a plurality of core pieces that are located inside and outside the winding portion; an interposed member that is interposed between the coil and the magnetic core; and a resin mold portion that includes an outer covering portion that covers at least a portion of an outer core piece of the magnetic core, the outer core piece being located outside the winding portion.

The interposed member includes an outer interposed portion that is interposed between an end surface of the winding portion and an inner end surface of the outer core piece, and the outer interposed portion has a hole on the outer core piece side, through which a portion of the inner end surface of the outer core piece is exposed from the resin mold portion.

The above-described reactor includes an interposed member that has a hole. Therefore, for the reason (A) below, the magnetic core, particularly the outer core piece, is unlikely to be displaced relative to the mold when the resin mold portion is molded.

(A) When the resin mold portion is to be formed, the hole can be used as a pin hole into which a pin that protrudes from the inner surface of the mold is inserted. Specifically, when the above-described pin is inserted into the hole, the above-described pin comes into direct contact with a portion of the inner end surface of the outer core piece, the portion being exposed from the hole. Therefore, if filling directions of the material of the resin mold portion (hereinafter also referred to as "mold material") include a direction in which the outer core piece is brought closer to the coil (hereinafter also referred to as "direction toward the coil"), the above-described pin is located on the opposite side in a direction toward the coil and can support the outer core piece. Even if the filling pressure of the mold material increases, the above-described pin can support the outer core piece as described above. In this way, it is possible to restrict the outer core piece from moving toward the coil, using the pin that is inserted into the hole. Typically, the outer core piece is a heavy object mainly made of a soft magnetic material such as iron, and if a frame bobbin that is made of a thin resin, as disclosed in Patent Document 1, is used, it is conceivable that it is difficult to satisfactorily restrict the outer core piece from being displaced. However, with the above-described reactor, it is possible to satisfactorily support the outer core piece due to the outer interposed portion and the above-described pin engaging with each other.

The above-described reactor appropriately has a predetermined inductance for the reason (B) below.

(B) Due to the presence of the above-described pin of the mold, it is possible to position the outer interposed portion at a predetermined position of the mold. Also, it is possible to position the coil and the magnetic core with reference to the outer interposed portion. That is, it is possible to position the outer core piece relative to the coil, and furthermore, it is possible to position the outer core piece relative to a core piece (the inner core piece described below) that is located inside the winding portion. It is possible to mold the resin mold portion in such a positioned state, while appropriately keeping the position of the outer core piece as described above. Therefore, it is possible to prevent fluctuations in inductance from occurring due to displacement.

Furthermore, with the above-described reactor, it is easier to perform positioning within the mold, which leads to excellent productivity. Also, with the above-described reactor, when supporting the outer core piece in a direction that is opposite a direction toward the coil, using the above-described pin of the mold, it is easier to position the above-described pin without interference with (without being hindered by) the outer interposed portion, which also leads to excellent productivity.

(2) In another aspect of the above-described reactor, for example: the magnetic core includes an inner core piece that is located inside the winding portion, and at least one gap portion that is interposed between core pieces that are adjacent to each other, the outer interposed member has a through hole that penetrates through a winding portion side surface thereof and an outer core piece side surface thereof so that an end surface of the inner core piece is exposed from the hole, the interposed member includes an inner interposed portion that is interposed between an inner circumferential surface of the winding portion and an outer circumferential surface of the magnetic core, and that is provided with an interposed protruding portion that keeps an interval between core pieces that are adjacent to each other, and the resin mold portion includes an inner covering portion that is continuous with the outer covering portion and covers at least a portion of the inner core piece, and a resin gap portion that constitutes the gap portion.

According to the above-described aspect, in the manufacturing process, it is possible to appropriately keep the interval between core pieces that are adjacent to each other, due to the presence of the interposed protruding portion, and it is possible to accurately form the resin gap portion that corresponds to the length of this interval, for the following reasons. Therefore, according to the above-described aspect, a gap plate that is independent of core pieces is not required, and the process of joining core pieces to a gap plate can be omitted, which also leads to excellent productivity.

In the manufacturing process, before the resin gap portion is formed, an area where the interposed protruding portion is formed, and a space in which the interposed protruding portion is not present and that is to be filled with mold material so that the resin gap portion is formed, are present between core pieces that are adjacent to each other. In a case where the filling directions of the mold material include a direction toward the coil, if the outer core piece is not supported by the above-described pin of the mold, there is the risk of the outer core piece moving as it is pressed by the mold material, to narrow the interval of the above-described space. Due to such displacement of the outer core piece, there is the risk of some of the areas that ultimately serve as resin gap portions between core pieces, being not appropriately supported at predetermined intervals. If the filling pressure of mold material increases the pressure applied to the outer core piece increases, and the above-described areas are likely to be further narrowed. If some of the intervals between core pieces are different, the thickness of resin gap portions will ultimately be non-uniform. As a result, the magnetic gap length fluctuates, which may lead to fluctuations in inductance. In contrast, according to the above-described aspect, the above-described pin is inserted into the hole, and thus the outer core piece is prevented from moving in a direction toward the coil. As a result, it is possible to form the resin gap portion while appropriately keeping the interval between core pieces that are supported by the interposed protruding portion.

Also, according to the above-described aspect, the resin gap portion prevents inductance from fluctuating due to variations in the interval between core pieces, and thus it is possible to keep a predetermined inductance over a long time, and improve reliability.

Furthermore, according to the above-described aspect, the outer covering portion and the inner core portion are continuous, and therefore the outer core piece and the inner core piece are integrated into one piece using the resin mod portion. The resin gap portion interposed between core pieces serves as a joining member that joins the core pieces to each other. Therefore, according to the above-described aspect, the resin mold portion firmly integrates the core pieces with each other into one piece. Thus, mechanical properties are excellent. Furthermore, it is possible to improve the rigidity of the integrated one piece, and prevent vibrations, noise, and so on from occurring. In addition, according to the above-described aspect, due to the resin mold portion being provided, it can be expected that the reactor will be protected from external factors (corrosion protection for core pieces, for example), insulation regarding the coil and external components will be improved, and, depending on the constituent material of a covering member, heat dissipation properties will be improved, for example.

(3) In another aspect of the above-described reactor, for example: the inner end surface of the outer core piece is provided with a cutout that constitutes a portion of an internal space of the hole.

The cutout according to the above-described aspect can be used as an engagement portion that engages the outer core piece with the above-described pin of the mold. According to the above-described aspect, the outer core piece itself has an engagement portion that engages with the above-described pin, and the contact area between the outer core piece and the above-described pin is larger than when the above-described pin is in contact with only a portion of the inner end surface of the outer core piece. Therefore, the outer core piece is less likely to be displaced due to the above-described pin being inserted into the hole (the cutout). Thus, it is possible to accurately keep the position of the outer core piece when molding the resin mold portion. Also, according to the above-described aspect, it is possible to easily and accurately position the outer core piece. Therefore, according to the above-described aspect, productivity is even more excellent. Furthermore, a portion of the thickness of the above-described pin can be received by the hole of the outer interposed portion (the groove described below), and the remaining portion can be received by the cutout of the outer core piece. Accordingly, as the above-described pin, it is possible to use a pin that has a sufficiently large cross-sectional area (a large thickness or diameter), relative to the thickness of the outer interposed portion, and that has high rigidity. Therefore, according to the above-described aspect, even if the filling pressure of mold material increases, it is possible to firmly support the outer core piece and position the outer core piece with high accuracy, using the pin. Since it is possible to increase the filling pressure of mold material, it is possible to accurately mold the resin mold portion, reduce the time required to complete filling, and so on.

(4) In another aspect of the above-described reactor, for example: the end surface of the winding portion is provided with an inner circumference side area that bulges in an axial direction of the winding portion, relative to an outer circumference side area of the end surface of the winding portion, and a surface of the outer interposed portion, the surface facing the end surface of the winding portion, is provided with a recessed portion into which the inner circumference side area is fitted.

As described above, the outer interposed portion itself is positioned using the above-described pin of the mold, and the winding portion can be positioned as a result of the winding portion being fitted into the recessed portion of the outer interposed portion. Also, the winding portion and the outer interposed portion can be brought into intimate contact. Therefore, in the manufacturing process, it is also unlikely that the winding portion will be displaced, and it is possible to form the resin mold portion in a state where the coil and the magnetic core are supported at appropriate positions. Thus, productivity is excellent. Therefore, according to the above-described aspect, the reactor has a predetermined inductance as desired. Also, it is possible to reduce dead space due to the above-described intimate contact, and therefore the reactor according to the above-described aspect is downsized.

(5) A reactor manufacturing method according to one aspect of the present description includes: a step of putting a combined body into a mold, and forming a resin mold portion, the combined body including: a coil that includes a winding portion; a magnetic core that includes a plurality of core pieces that are located inside and outside the winding portion; and an interposed member that is interposed between the coil and the magnetic core, and the resin mold portion covering at least a portion of an outer core piece of the magnetic core, the outer core piece being located outside the winding portion.

The interposed member includes an outer interposed portion that is interposed between an end surface of the winding portion and an inner end surface of the outer core piece, and the outer interposed portion has a hole on the outer core piece side, through which a portion of the inner end surface of the outer core piece is exposed, and the resin mold portion is formed in a state where a pin that protrudes from an inner surface of the mold is inserted into the hole so that a portion of the inner end surface is supported.

With the above-described reactor manufacturing method, when the resin mold portion is to be molded, a portion of the inner end surface of the outer core piece is supported by the above-described pin of the mold inserted into the hole.

Therefore, for the reason (A) above, the magnetic core, particularly the outer core piece, is unlikely to be displaced relative to the mold. Also, for the reason (B) above, the above-described reactor manufacturing method can be employed to manufacture a reactor with high productivity. Specifically, it is possible to manufacture a reactor that has a predetermined inductance as desired.

The following specifically describes embodiments of the present description with reference to the drawings. The same reference numerals in the drawings refer to components with the same name.

First Embodiment

Figure 3A:
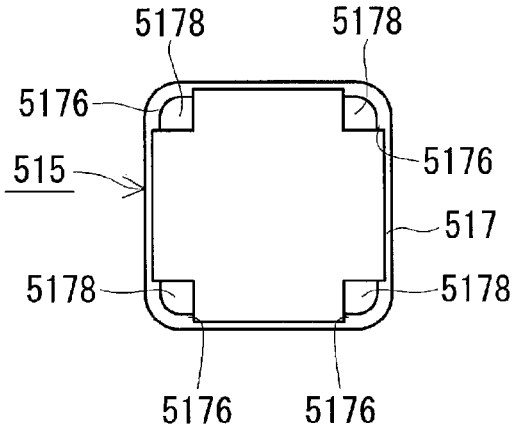
FIG. 3A is a front view of an inner interposed portion of an interposed member that is included in the reactor according to the first embodiment, in which an end portion interposed piece is seen in a direction in which an inner core piece is fitted.
Figure 3B:
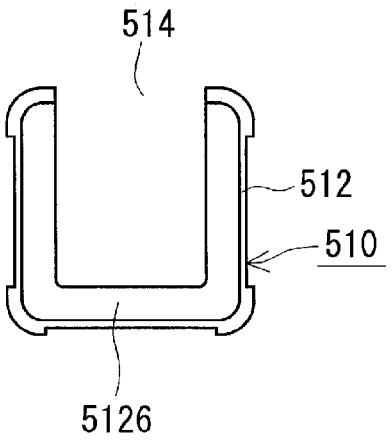
FIG. 3B is a front view of an intermediate interposed piece, showing an inner interposed portion of the interposed member that is included in the reactor according to the first embodiment.
Figure 3C:
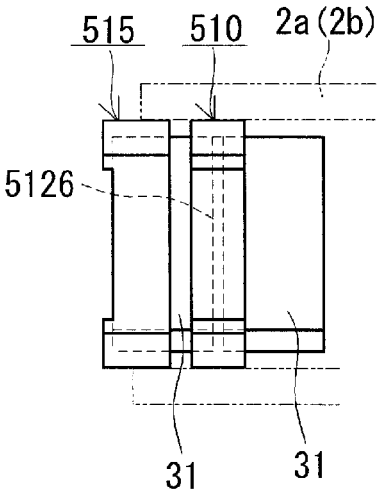
FIG. 3C is a side view of an inner interposed portion of the interposed member that is included in the reactor according to the first embodiment, showing a state in which an end portion interposed piece and an intermediate interposed piece are attached to inner core pieces that are adjacent to each other.
Figure 3D:
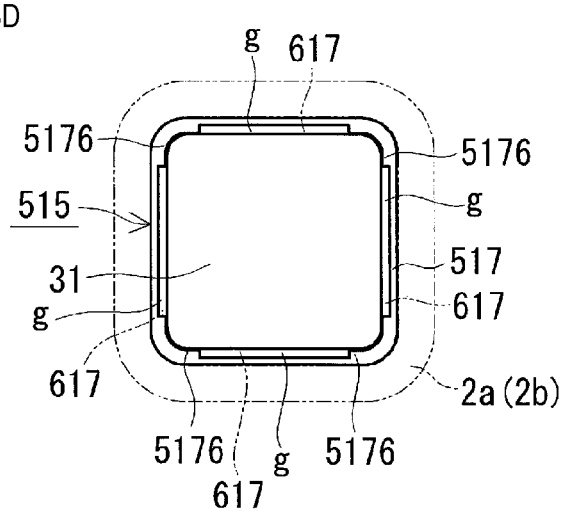
FIG. 3D is a front view of an inner interposed portion of the interposed member that is included in the reactor according to the first embodiment, showing a state in which an inner core piece is attached to the end portion interposed piece in FIG. 3A.
Figure 3E:
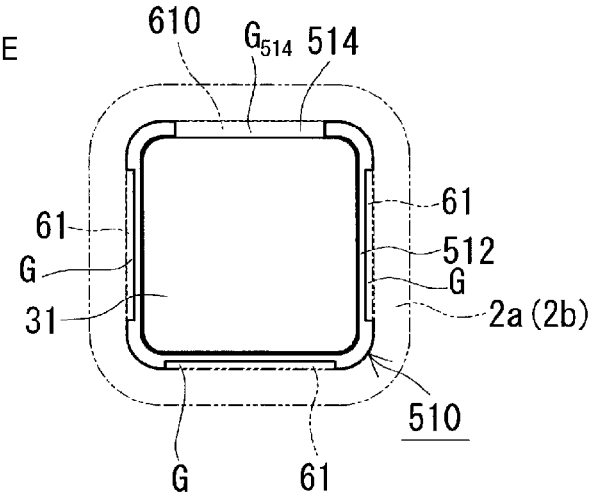
FIG. 3E is a front view of an inner interposed portion of the interposed member that is included in the reactor according to the first embodiment, showing a state in which an inner core piece is attached to the end portion interposed piece in FIG. 3B.
Figure 4:
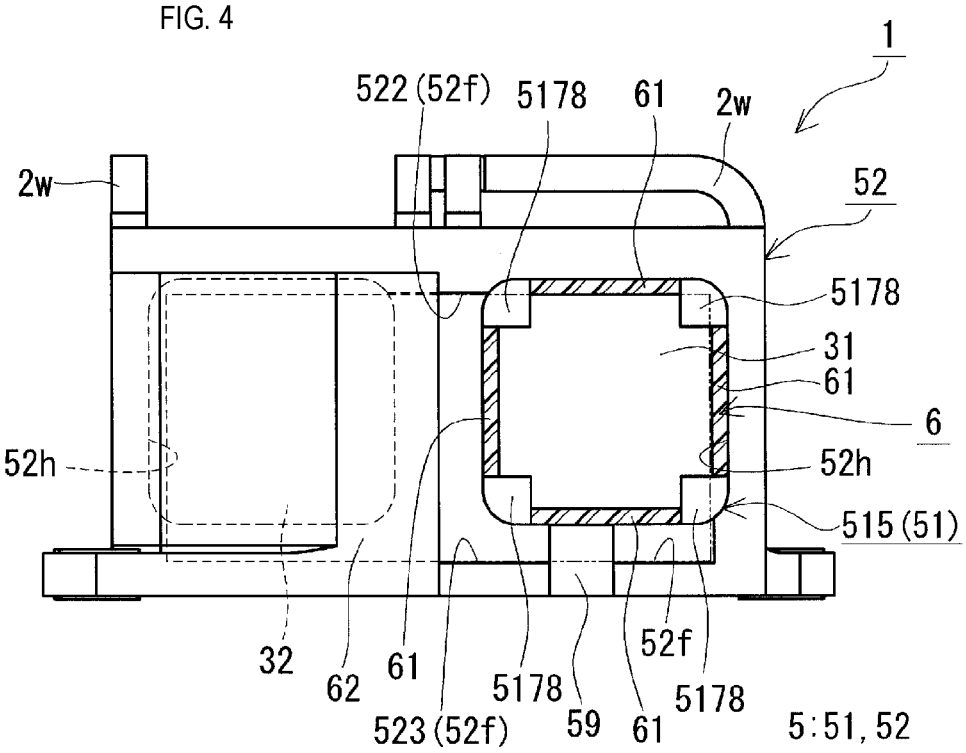
FIG. 4 is a front view of the reactor according to the first embodiment seen in an axial direction of a coil from an outer core piece side, only showing the left half of the outer core piece.

The following describes a reactor 1 according to a first embodiment with reference to FIGS. 1 to 5. In FIG. 1, a winding portion 2*a* is partially cut out so that the inside of a coil 2 can be clearly seen. In FIG. 4, an outer core piece 32 is cut along a cutting line (IV)-(IV) in FIG. 1, the right half of the outer core piece 32 is removed, and the left half thereof is only shown so that an outer core piece 32 side surface of an outer interposed portion 52 can be clearly seen.

Reactor

Overall Configuration

As shown in FIG. 1, the reactor 1 according to the first embodiment includes: a coil 2 that includes winding portions 2*a* and 2*b* that are tubular; a magnetic core 3 that includes a plurality of core pieces that are provided inside and outside the winding portions 2*a* and 2*b*; an interposed member 5 that is interposed between the coil 2 and the magnetic core 3; and a resin mold portion 6 that covers at least a portion of the outer circumferential surface of the magnetic core 3. The coil 2 in this example is not covered by the resin mold portion 6, and is exposed to the outside. Typically, the reactor 1 is attached to an installation target (not shown) such as a converter case, and used. FIG. 1 shows an example in which the installation side when the reactor 1 is installed is the lower side and the opposite side is the upper side.

The magnetic core 3 included in the reactor 1 includes, as core pieces, a pair of outer core pieces 32 that are located outside the winding portions 2*a* and 2*b*. The magnetic core 3 in this example includes a plurality of inner core pieces 31 (see FIG. 2 also) that are respectively located inside the winding portions 2*a* and 2*b*, and at least one gap portion (a plurality of gap portions in this example) that is interposed between core pieces that are adjacent to each other.

The interposed member 5 included in the reactor 1 includes outer interposed portions 52 that are respectively interposed between the end surfaces of the winding portions 2*a* and 2*b* and inner end surfaces 32*e* (FIG. 5) of the outer core pieces 32. Each of the outer interposed portions 52 in this example has a frame plate shape, and is provided with a through hole 52*h* (FIG. 2) that penetrates through the front and rear surfaces. Also, the interposed member 5 in this example is independent of the outer interposed portions 52, and includes inner interposed portions 51 that are respectively interposed between the inner circumferential surfaces of the winding portions 2*a* and 2*b* and the outer circumferential surface of the magnetic core 3. The inner interposed portions 51 in this example are configured such that resin gap portions 60 described below (FIG. 1) can be formed (details will be described later).

As shown in FIG. 1, the resin mold portion 6 included in the reactor 1 includes: outer covering portions 62 that cover at least portions of the outer core pieces 32; inner covering portions 61 that are continuous with the outer covering portions 62 and cover at least portions of the inner core pieces 31; and resin gap portions 60 that constitute the above-described gap portions. In this example, a resin gap portion 60 is provided between an inner core piece 31 and an outer core piece 32, and between inner core pieces 31.

Figure 2:
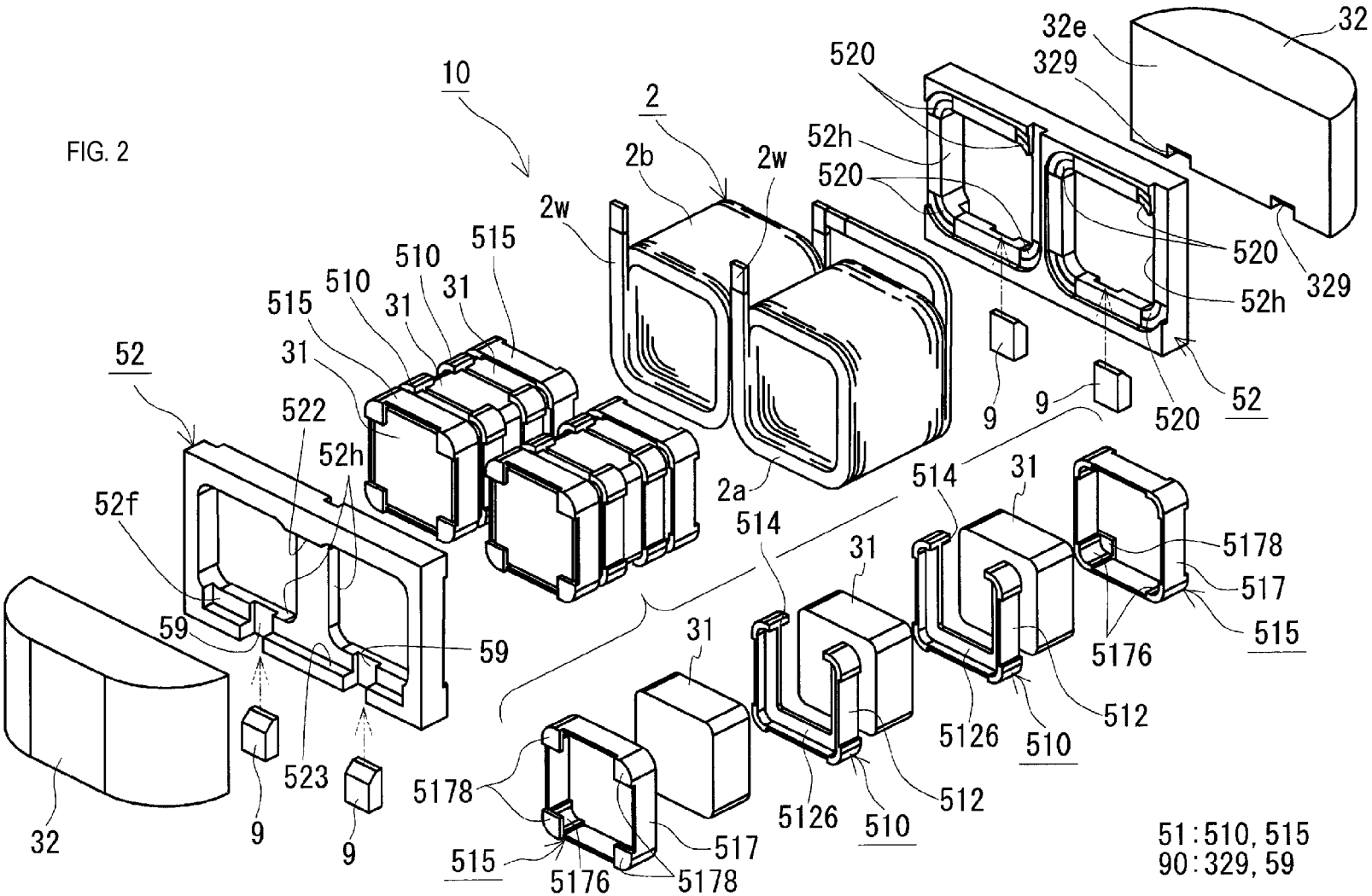
FIG. 2 is an exploded perspective view of a combined body that is included in the reactor according to the first embodiment.

One feature of the reactor 1 according to the first embodiment is that the outer interposed portions 52 are each provided with holes 90 (FIG. 5) on the outer core piece 32 side (hereinafter also referred to as "outer core side"). In this example, the inner end surfaces 32*e* of the outer core pieces 32 are provided with cutouts 329 that constitute portions of the internal spaces of the holes 90 (FIG. 2). Also, grooves 59 are formed in the outer interposed portions 52 on the installation surface side (FIG. 2). The cutouts 329 of the outer core pieces 32 and the grooves 59 of the outer interposed portion 52 form the holes 90 together. The holes 90 are used in the process of manufacturing the reactor 1 to position the outer core pieces 32 relative to a mold (not shown) that is used to mold the resin mold portion 6, such that pins 9 (FIG. 2) are inserted into the holes 90 as described below, and thus the outer core pieces 32 are prevented from being displaced.

The following describes overviews of the coil 2 and the magnetic core 3, which are main members of the reactor 1, and then describes the details of the interposed member 5, which is one feature, and the details of the resin mold portion 6.

Coil

The coil 2 in this example is formed by joining and integrating individual winding portions 2*a* and 2*b* into one piece as shown in FIG. 2. Specifically, each of the winding portions 2*a* and 2*b* has a tubular shape formed by spirally winding one continuous winding wire 2*w*, and the winding portions 2*a* and 2*b* are arranged in parallel (side by side) such that the axes thereof extend in parallel with each other. End portions of the winding wires 2*w* are joined to each other through welding, crimping or the like so that a joining point is formed, and as a result of such joining, the coil 2 constitutes an integrated member that is electrically connected. FIG. 2 shows an example in which one end portion of the winding wire 2*w* that forms the one winding portion 2*b* is drawn out upward away from the winding portion 2*b*, and the winding wire 2*w* that forms the other winding portion 2*a* is bent toward the one winding portion 2*b*, and thus both end portions are brought close to each other. The other end portions of the winding wires 2*w* extend from the winding portions 2*a* and 2*b* in appropriate directions, and to which terminal members (not shown) are connected. Although FIG. 2 shows that the other end portions are drawn out upward away from the winding portions 2*a* and 2*b*, directions in which the other end portions are drawn out may be changed as appropriate. An external device such as a power supply that supplies power to the coil 2 is connected via the above-described terminal members.

The end surfaces of the winding portions 2*a* and 2*b* in this example each have a square shape with rounded corners. Also, each winding wire 2*w* in this example is a coated flat wire (a so-called enameled wire) that includes: a conductor (copper or the like), which is a flat wire; and an insulative coating (polyamide or the like) that covers the outer circumferential surface of the conductor, and the winding portions 2*a* and 2*b* are edgewise coils.

Magnetic Core

As described above, the magnetic core 3 includes a plurality of inner core pieces 31, a pair of outer core pieces 32, and a plurality of gap portions (resin gap portions 60). As shown in FIGS. 2, 3D, and 3E, the inner core pieces 31 are columnar members whose end surfaces each have a square shape with rounded corners, corresponding to the shape of the winding portions 2*a* and 2*b*. Each of the outer core pieces 32 shown in FIG. 2 is a columnar member whose installation surface (lower surface) and opposite surface (upper surface) are dome-shaped. The inner end surface 32*e*, which serves as a surface for connection with an end surface of an inner core piece 31, of each outer core piece 32 is constituted by a uniform flat surface, except for the cutouts 329 formed in portions of the corners on the installation surface. The installation surfaces of the outer core pieces 32 protrude so as to be closer to the installation target than the installation surfaces of the inner core pieces 31 are (see the inner core piece 31 on the right and the outer core piece 32 indicated by the dashed line in FIG. 4). The pair of outer core pieces 32 are attached so as to connect the pair of stacked portions in each of which the plurality of inner core pieces 31 and the resin gap portions 60 are alternatingly arranged, and thus a magnetic core 3 that is ring-shaped is formed. The magnetic core 3 forms a closed magnetic circuit when the coil 2 is excited. The cutouts 329 will be described in the section regarding the outer interposed portions 52 of the interposed member 5.

The inner core pieces 31 and the outer core pieces 32 are mainly made of a soft magnetic material. Examples of a soft magnetic material include iron and an iron alloy (an Fe—Si alloy, an Fe—Ni alloy, or the like). The inner core pieces 31 and the outer core pieces 32 are, for example, powder compacts formed by compression-molding powder that is made of a soft magnetic metal material or coated powder that is composed of particles with insulative coatings, or molded members that are made of composite materials including soft magnetic powder and resin. The details of the resin gap portions 60 will be described in the section regarding the resin mold portion 6.

Interposed Member

The following describes the interposed member 5 mainly with reference to FIGS. 2 to 5.

Overview

The interposed member 5 is typically made of an insulative material, and serves as an insulation member between the coil 2 and the magnetic core 3. Also, the interposed member 5 is formed so as to have predetermined dimensions and a predetermined shape as described below, and serves as a positioning member that positions the inner core pieces 31 and the outer core pieces 32 relative to the winding portions 2*a* and 2*b*. The inner interposed portions 51 in this example insulate the inner circumferential surfaces of the winding portions 2*a* and 2*b* and the inner core pieces 31 from each other, and position the inner core pieces 31 relative to the winding portions 2*a* and 2*b*. The outer interposed portions 52 in this example insulate the end surfaces of the winding portions 2*a* and 2*b* and the outer core pieces 32 from each other, and position the outer core pieces 32 relative to the winding portions 2*a* and 2*b*. As a result, the interposed member 5 positions the inner core pieces 31 and the outer core pieces 32.

In the reactor 1 according to the first embodiment, the outer interposed portions 52 are provided with the holes 90, and when the resin mold portion 6 is molded, the interposed member 5 also serves as a positioning member that particularly prevents the outer core pieces 32 from being displaced from a mold that is used to perform molding, to position the outer core pieces 32 relative to the mold. In the reactor 1 in this example, the inner interposed portions 51 are provided with interposed protruding portions 5126 that keep the intervals between core pieces (inner core pieces 31 in this example) that are adjacent to each other, and thus the interposed member 5 also serves as a gap forming member.

Furthermore, when the resin mold portion 6 is molded, the outer interposed portions 52 in this example separate core housing spaces in which the outer core pieces 32 are housed from a coil housing space in which the coil 2 sandwiched between the outer core pieces 32 is housed, to prevent mold material from being supplied into the coil housing space. In a state where the outer core pieces 32, the inner core pieces 31, and the interposed member 5 are assembled, specific gaps described below (e.g. gaps g in FIG. 3D) are formed therebetween. The above-described specific gaps provided around the inner core pieces 31 housed in the coil housing space are in communication with the core housing space on each outer core piece 32 side. These communication spaces allow mold material to flow from each outer core piece 32 side to the inner core pieces 31 side. That is, the above-described specific gaps are used as resin flow paths when the resin mold portion 6 is formed. Therefore, the interposed member 5 also serves as a partition member in the mold and a member for forming a resin flow path of mold material.

The following describes the outer interposed portions 52 and the inner interposed portions 51 one after the other. How to use the holes 90 will be described in the section regarding the method for manufacturing a reactor according to the embodiment.

Outer Interposed Portions

As shown in FIG. 2, each outer interposed portion 52 in this example is a rectangular frame member that is provided with a pair of through holes 52*h* that are arranged side by side in a central portion thereof. The through holes 52*h* penetrate through the winding portions 2*a* and 2*b* side (hereinafter also referred to as "coil side") surface and the outer core side surface. Therefore, the end surfaces of the inner core pieces 31 at the ends of the set of inner core pieces 31 are exposed toward the inner end surfaces 32*e* of the outer core pieces 32 (see the right half in FIG. 4 also). In this example, the outer core side of each outer interposed portion 52, which is located so as to face the inner end surface 32*e* of an outer core piece 32, is recessed such that the inner end surface 32*e* of the outer core piece 32 can be fitted thereinto. Two through holes 52*h* are open in a bottom portion of this recess. Each outer interposed portion 52 is provided with core holes 52*f* on the outer core side. The core holes 52*f* are open in the opening edge of the above-described recess, and form spaces that are in communication with the through holes 52*h* (see the outer interposed portion 52 on the left in FIG. 2). An outer core-side central portion of the outer interposed portion 52 is recessed, and thus the thickness of this central portion is smaller than the thickness of the peripheral portion. When the inner core pieces 31, the outer core pieces 32, and the outer interposed portions 52 are assembled, the central portions are interposed between the inner core pieces 31 and the outer core pieces 32. Therefore, the interval between the inner core pieces 31 and the outer core pieces 32 is kept to a length corresponding to the thickness of the above-described central portions. In the manufacturing process, the gaps that are formed between the inner core pieces 31 and the outer core pieces 32 due to the presence of the above-described central portions are used as resin flow paths, and are ultimately filled with a portion of the resin mold portion 6. Therefore, the reactor 1 is also provided with resin gap portions between the inner core pieces 31 and the outer core pieces 32.

Dimensions

In a state where an outer interposed portion 52 in this example is attached to an outer core piece 32 (see the dashed line and the two-dot chain line in FIG. 4), the outer interposed portion 52 is larger than the outer core piece 32, and has a peripheral portion that surrounds the outer core piece 32. That is, the outer interposed portion 52 has a portion that protrudes relative to the installation surface of the outer core piece 32 (the lower portion in FIG. 4), and portions that protrude relative to the side surfaces of the outer core piece 32 (the left and right portions in FIG. 4). In addition, the dimensions of the outer interposed portions 52 in this example are determined such that, when the outer interposed portions 52 are attached to the coil 2, the installation surfaces (lower surfaces) of the winding portions 2*a* and 2*b* and the installation surfaces (lower surfaces) of the outer interposed portions 52 are substantially flush, and the side surfaces (the left and right surfaces) of the winding portions 2*a* and 2*b* and the side surfaces (the left and right surfaces) of the outer interposed portions 52 are substantially flush (see FIG. 5 also). Therefore, when housed in the mold for molding the resin mold portion 6, the installation surfaces of the winding portions 2*a* and 2*b* and the installation surfaces of the outer interposed portions 52 are supported by the inner surfaces of the mold. Furthermore, the dimensions of the outer interposed portions 52 have been adjusted such that, when the outer interposed portions 52, the coil 2, and the outer core pieces 32 are assembled, the surfaces (the upper surfaces) opposite to the installation surfaces of the outer interposed portions 52 are located higher than the surfaces (the upper surfaces) opposite to the installation surfaces of the winding portions 2*a* and 2*b* and the outer core pieces 32. In the above-described assembled state, the coil 2, excluding end portions of the winding wires 2*w*, does not protrude from the outer interposed portions 52.

Figure 5:
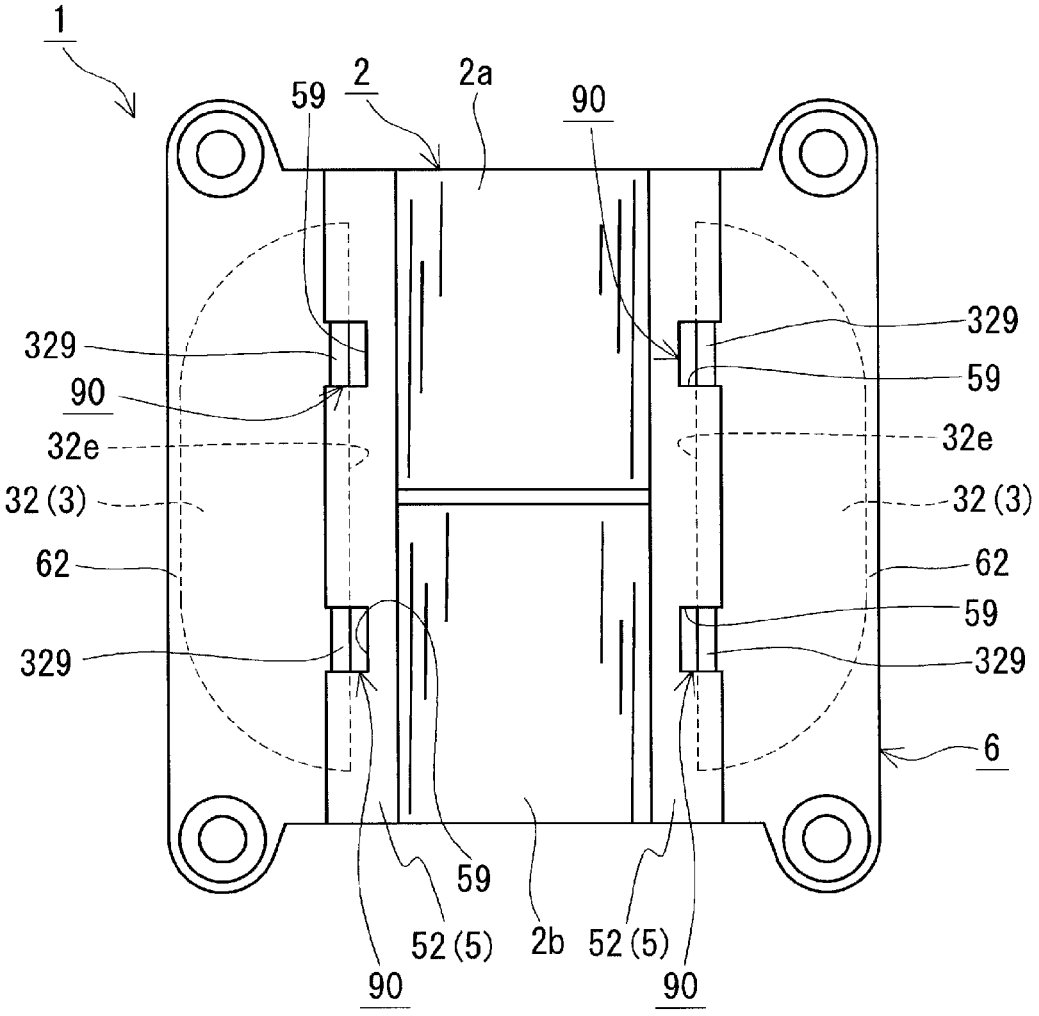
FIG. 5 is a bottom view showing the reactor according to the first embodiment.

The thickness of the central portions of the outer interposed portions 52 can be selected as appropriate, considering, for example, insulation required between the winding portions 2*a* and 2*b* and the magnetic core 3. In this example, as described above, the thickness of the central portions is smaller than the thickness of the peripheral portions. The thickness of the peripheral portions is large enough so that the grooves 59 (FIG. 2) described below can be formed (FIGS. 2 and 5).

Coil Side

The outer interposed portions 52 in this example are provided with fitting grooves on the coil side, into which portions in the vicinity of the end surfaces of the winding portions 2*a* and 2*b* are fitted. The fitting grooves are ring-shaped so as to match the shapes of the end surfaces of the winding portions 2*a* and 2*b* (see the outer interposed portion 52 on the right side in FIG. 2). The portions in the vicinity of the end surfaces of the winding portions 2*a* and 2*b* are fitted into the fitting grooves, and thus the coil 2 and the outer interposed portions 52 can be positioned. Central portions of the fitting grooves are respectively provided with the through holes 52*h* that have substantially the same size as the inner circumferential contours of the winding portions 2*a* and 2*b*, or a slightly larger size than the inner circumferential contours.

Furthermore, the fitting grooves of the outer interposed portions 52 in this example are provided with recessed portions 520 in which the corners of the end surfaces of the winding portions 2*a* and 2*b* are housed (see the outer interposed portion 52 on the right side in FIG. 2). Here, when a winding wire 2*w* is wound so as to form a tubular shape, an inner circumference side area of this tubular member is more likely to bulge in the axial direction of the tubular member compared to an outer circumference side area thereof. As in this example, if the winding portions 2*a* and 2*b* are edgewise coils, and the end surfaces thereof have a square shape with rounded corners, for example, the bending radius of each corner is small, and the above-described bulging is likely to occur at the corners. Therefore, in some cases, the end surfaces of the winding portions 2*a* and 2*b* include inner circumference side areas that further bulge in the axial direction, relative to outer circumference side areas of the winding portions 2*a* and 2*b*. The outer interposed portions 52 are provided with the recessed portions 520 on the coil side that faces the end surfaces of the winding portions 2*a* and 2*b*, into which such bulging inner circumference side areas (the corners and the vicinity thereof) are fitted. Thus, the winding portions 2*a* and 2*b* and the outer interposed portions 52 come into intimate contact. In addition, the outer interposed portions 52 in this example are also provided with draw-out grooves on the coil side, which are provided so as to extend in a direction in which the other end portions of the winding wires 2*w* in the winding portions 2*a* and 2*b* are drawn out. Therefore, the winding portions 2*a* and 2*b* and the outer interposed portions 52 are more likely to come into intimate contact. As a result of the winding portions 2*a* and 2*b* and the outer interposed portions 52 being in intimate contact, it is possible to accurately position them. Also, as a result of the intimate contact, even if the coil 2 is not covered by the resin mold portion 6 and is exposed to the outside as in this example, it is easy to prevent mold material from leaking to the coil 2 side in the manufacturing process.

Outer Core Side

The dimensions of an imaginary surface formed by the opening edges of the core holes 52*f* provided in each outer interposed portion 52 in this example on the outer core side is slightly larger than the dimensions of the inner end surfaces 32*e* of the outer core pieces 32. Therefore, when outer core pieces 32 are fitted into the core holes 52*f* in the manufacturing process, gaps are provided between the outer peripheral surfaces of the outer core pieces 32 and the inner peripheral surfaces that form the core holes 52*f*. In the right half of FIG. 4, such a gap is provided between the surface (upper surface) opposite to the installation surface and the side surface (right surface) of the outer core piece 32, and a portion of the inner peripheral surface that forms the core hole 52*f*, the portion overlapping the opening edge of the through hole 52*h*. These gaps are used as resin flow paths in the manufacturing process, and ultimately, portions of the resin mold portion 6 (in FIG. 4, portions of the inner covering portions 61 described below, the portions overlapping an upper portion and a right portion) are provided. Also, when the coil 2 and the interposed member 5 are assembled, and they, without the outer core pieces 32, are seen from the outer core side of an outer interposed portion 52, the winding portions 2*a* and 2*b* are covered by the outer interposed portion 52 and cannot be seen as shown in the right half of FIG. 4. An end surface of the inner core piece 31 and a portion of the inner interposed portion 51 (end surface restriction portions 5178 of the end portion interposed piece 515 described below) are exposed from the through hole 52*h*, and can be seen. With such a configuration, it is possible to inject mold material into the winding portions 2*a* and 2*b* via the above-described gaps from the outer core side, and it is possible to prevent mold material from leaking to the outer circumferential surfaces of the winding portions 2*a* and 2*b*, using the outer interposed portions 52.

To form the above-described gaps and support the outer core pieces 32, the inner circumferential surface of each core hole 52*f* in this example is provided with a protruding portion 522, which supports the surface (the upper surface) opposite to the installation surface of the outer core piece 32, and a support surface 523, which supports a portion of the installation surface (the lower surface). A pair of surfaces (the upper and lower surfaces) that face each other of an outer core piece 32 fitted into a core hole 52*f* are sandwiched by the inner end surface of the protruding portion 522 and the support surface 523, and are thus positioned by an outer interposed portion 52. Also, gaps are provided between the upper surfaces of the outer core pieces 32 and the opening edges of the core holes 52*f*, and side surfaces of the outer core pieces 32 and the opening edges of the core holes 52*f* (see and compare between the two-dot chain line and the core hole 52*f* in FIG. 4). The dimensions and shapes of the core holes 52*f*, the protruding portions 522, and the support surfaces 523 may be selected as long as predetermined gaps can be provided.

Holes

As shown in FIG. 5, in the reactor 1 according to the first embodiment, the outer interposed portions 52 are each provided with holes 90 on the installation surface side (lower side), into which pins 9 (FIG. 2) that protrude from the inner surface of a mold (not shown) are inserted when the resin mold portion 6 is formed. The holes 90 in this example are stopper holes that are formed by the grooves 59 (see FIGS. 2 and 4 also) provided in the outer interposed portions 52 and the cutouts 329 (see FIG. 2 also) provided in the inner end surfaces 32*e* of the outer core pieces 32, and are provided so as to correspond to the pins 9 in contour, dimensions, and number. The surfaces that define the holes 90 are constituted by the surfaces that define the grooves 59 in the outer interposed portion 52 and the surfaces that define the cutouts 329 in the outer core pieces 32. The openings of the holes 90 are constituted by the openings of the cutouts 329 on the installation surface side and the openings of the grooves 59 of the outer interposed portion 52 on the installation surface side. The internal spaces of the holes 90 are constituted by the internal spaces of the grooves 59 and the internal spaces of the cutouts 329. The holes 90 allow portions of the inner end surfaces 32*e* of the outer core pieces 32 to be exposed to the outside from the resin mold portion 6. The portions of the inner end surfaces 32*e* exposed from the resin mold portion 6 come into contact with the pins 9 when the resin mold portion 6 is molded, and this can be the basis indicating that the portions were supported by the pins 9.

Pins

The shape, dimensions, and number of the pins 9 can be selected as appropriate. FIG. 2 shows examples of the pins 9 that are each formed by rounding one corner of a rectangular parallelepiped, and are provided with an inclined surface (chamfered portion) on the leading end portion side in the direction in which the pin 9 is inserted into a hole 90. Alternatively, the shape of each pin 9 may be a prismatic shape such as a rectangular parallelepiped shape, a triangular prism shape, or a hexagonal prism shape, or a columnar shape having a curved surface, such as a circular column shape or an elliptical column shape, for example. The pins 9 that each have an inclined surface as in this example can be easily inserted into the holes 90, and thus workability is excellent. Also, due to a configuration in which the surfaces of the outer core pieces 32 where the cutouts 329 are formed are pressed against and supported by the inclined surfaces of the pins 9, it is easy to reduce the size of the grooves 59 in the outer interposed portions 52, and reduce a decrease in the strength of the outer interposed portions 52 due to the grooves 59 being formed. Although this example shows a case in which two pins 9 are provided for one pair composed of an outer core piece 32 and an outer interposed portions 52, one pin 9, or three or more pins 9 may be provided. The larger the cross-sectional area of a pin 9 is and the larger the number of pins 9 is, the larger the area that is in contact with the outer core piece 32 is and the higher the rigidity of the pins 9 is, and as a result, the outer core piece 32 can be reliably supported. The dimensions, number, and so on of the pins 9 may be selected as appropriate as long as the dimensions of the outer interposed portions 52 do not increase and workability at the time of insertion is not degraded. Examples of the constituent material of the pins 9 include a material (typically, a metal) that has sufficient strength to support the outer core pieces 32 that are pressed against by mold material.

Grooves

As shown in FIG. 2, the grooves 59 in this example are provided so as to extend from the installation surfaces (the lower surfaces) of the outer interposed portions 52 to the through holes 52*h* via the core holes 52*f*, and are open on the installation surface side and on the outer core side. The openings on the installation surface side have a rectangular shape corresponding to the shape of the pins 9 that are rectangular parallelepiped (FIG. 5). In this example, two grooves 59 are provided for one outer interposed portion 52.

Cutouts

As shown in the outer core piece 32 on the right in FIG. 2, the cutouts 329 in this example are provided so as to extend from the installation surface (the lower surface) of the outer core piece 32 to the inner end surface 32*e* and are open on the installation surface side and the inner end surface 32*e* side. The openings on the installation surface side have a rectangular shape corresponding to the shape of the pins 9 that are rectangular parallelepiped (FIG. 5). A surface where a cutout 329 in this example is formed includes a surface that abuts against the inclined surface of a pin 9. Two cutouts 329 are provided for one outer core piece 32. The grooves 59 and the cutouts 329 are provided such that, in a state where the outer core pieces 32 and the outer interposed portions 52 are assembled, the openings of the grooves 59 on the outer core side and the openings of the cutouts 329 on the inner end surface 32*e* side are aligned with each other.

Note that, as described above, the outer core pieces 32 in this example have protruding portions that protrude past the installation surfaces of the inner core pieces 31, and the cutouts 329 are provided in these protruding portions. Thus, despite the cutouts 329 being provided, the influence on magnetic paths is small. Therefore, for example, in a case where pins 9 that have a large cross-sectional area are used, even if the proportion of the cutouts 329 formed in the holes 90 is larger than the grooves 59 formed therein, it is envisaged that the influence on the magnetic paths is small due to the cutouts 329 being provided in the protruding portions. Also, by increasing the proportion of the cutouts 329 formed in the holes 90, it is possible to increase the areas that are in contact with the pins 9 in the outer core pieces 32, and it is possible to firmly support the pins 9. Furthermore, in this case, it is possible to reduce the proportion of the grooves 59 formed in the holes 90, and therefore, it is possible to reduce the thickness of the outer interposed portions 52 to some extent, and downsize the reactor 1. As in this example, it is also possible to equalize the proportion of the cutouts 329 and the proportion of the grooves 59 formed in the holes 90.

Holes

In this example, the surfaces where the holes 90 are formed define rectangular parallelepiped spaces with rounded corners, corresponding to the pins 9 that are rectangular parallelepiped and have inclined surfaces. The surfaces of the pins 9 can be in surface contact with the surfaces where the holes 90 are formed, and therefore, the outer core pieces 32 are desirably supported by the pins 9 inserted into the holes 90. Also, the surfaces of the outer core pieces 32 where the cutouts 329 are formed, the surfaces of the outer interposed portions 52 where the grooves 59 are formed, and the side surfaces of the pins 9 are in surface contact with each other, and therefore, the outer core pieces 32 and the outer interposed portions 52 are restricted by the pins 9 from moving in the direction in which the winding portions 2*a* and 2*b* are arranged side by side. Due to such pins 9 and holes 90 engaging with each other, it is possible to accurately position the outer core pieces 32 and the outer interposed portions 52 in a mold and prevent them from being displaced.

The shape of the holes 90 and the shapes of the grooves 59 and the cutouts 329 can be changed as appropriate so as to correspond to the shape of the pins 9. For example, the shapes of the openings of the grooves 59 and the cutouts 329 on the installation surface side may be triangular (in this case, the pins 9 have a quadrangular prism shape, for example) or semicircular (in this case, the pins 9 have a circular column shape, for example).

The depth of the holes 90 can be selected as appropriate. In this example, the grooves 59 reach the openings of the through holes 52*h*, and therefore, it is preferable that the range of depth is such that the through holes 52*h* are not closed off. This is because, if the through holes 52*h* are closed off by the pins 9 inserted into the holes 90, the amount of mold material interposed between the inner end surfaces 32*e* of the outer core pieces 32 and the end surfaces of the inner core pieces 31 decreases, which results in a decrease in the bonding strength between them.

Inner Interposed Portion

As shown in FIG. 2, the inner interposed portions 51 in this example include a plurality of divisional pieces that are located at predetermined intervals in the axial direction of the winding portions 2*a* and 2*b*. Specifically, each set of inner core pieces 31 (in this example, each set is composed of three inner core pieces 31) includes a plurality of intermediate interposed pieces 510 (two in this example) that are located at intermediate positions in the above-described axial direction, and a pair of end portion interposed pieces 515 that are respectively located at the ends in the above-described axial direction. Before the resin mold portion 6 is formed, spaces (step-like spaces between the outer circumferential surfaces of the inner core pieces 31 and the inner interposed portion 51) that correspond to the dimensions of the above-described intervals are provided around the outer circumferential surfaces of the inner core pieces 31 (see the assembly of the set of inner core pieces 31 and the inner interposed portions 51 in FIGS. 2 and 3C). Also, the intermediate interposed pieces 510 in this example do not cover the entire circumferences of the inner core pieces 31, and are cut out such that a portion of each inner core piece 31 in the circumferential direction is exposed to the outside. Therefore, before the resin mold portion 6 is formed, spaces (step-like spaces between the inner core pieces 31 and intermediate interposed pieces 510) are provided around the outer circumferential surfaces of the inner core pieces 31 (see a gap $G_{514}$ in FIG. 3E). Furthermore, although the end portion interposed pieces 515 in this example are ring-shaped members that each surround the entire circumference of an inner core piece 31, a predetermined interval is secured between each end portion interposed piece 515 and the outer circumferential surface of an inner core piece 31. Therefore, before the resin mold portion 6 is formed, spaces that correspond to the dimensions of the above-described intervals are provided around the outer circumferential surfaces of the inner core pieces 31 (see gaps gin FIG. 3D). These spaces can be used as resin flow paths of mold material when the resin mold portion 6 is formed.

Each intermediate interposed piece 510 has the same shape. Also, each end portion interposed piece 515 has the same shape. Therefore, the following description only illustrates one intermediate interposed piece 510 and one end portion interposed piece 515.

Intermediate Interposed Piece

As shown in FIGS. 2, 3B, and 3E, the intermediate interposed piece 510 in this example is a member formed by bending a band-like member so as to have a U-shape so as to match the shape of an inner core piece 31. In a state where an inner core piece 31 and an intermediate interposed piece 510 are assembled, the inner circumferential surface of the intermediate interposed piece 510 is substantially in contact with the inner core piece 31 (FIG. 3E, a small gap that may occur in assembly work is acceptable), and serves as a supporting surface (see FIG. 3C also).

Specifically, the intermediate interposed piece 510 includes: a body portion 512 that continuously covers a portion of the outer circumferential surfaces of inner core pieces 31 that are adjacent to each other; and a cutout portion 514 from which the above-described portions of the outer circumferential surfaces are exposed, and thus disconnects the body portion 512 in the circumferential direction. The body portion 512 in this example is a frame member whose end surface has a square shape with rounded corners, which corresponds to the inner core pieces 31 whose end surfaces have a square shape with rounded corners (FIGS. 3B and 3E). FIG. 3E shows an example of the body portion 512 that covers three surfaces (the left and right surfaces, and the lower surface), and the four rounded corners of the inner core piece 31, and does not cover one surface (the upper surface) of the inner core piece 31 so that the one surface is exposed to the outside. Note that the intermediate interposed piece 510 in this example has a rotationally symmetrical shape that remains the same when rotated from the state shown in FIG. 3B by 180° in the horizontal direction.

The circumferential length of the area of the body portion 512 that covers the outer circumferential surfaces of the inner core pieces 31 can be selected as appropriate. The shorter this circumferential length is (e.g. a configuration that includes a lower surface and two corners that are continuous with the lower surface), the longer the circumferential length of the cutout portion 514 is. As a result, the portions of the outer circumferential surfaces of the inner core pieces 31 exposed from the body portion 512 increase, and the above-described resin flow path increases. The longer the above-described circumferential length is, the shorter the circumferential length of the cutout portion 514 is. As a result, areas of the inner core pieces 31 supported by the body portion 512 increase, and the inner core pieces 31 and the intermediate interposed piece 510 are likely to be stable in an assembled state in the manufacturing process. If only one surface (the upper surface) of each inner core piece 31 is exposed to the outside as in this example, when the resin mold portion 6 is formed, mold material can be injected into a gap between core pieces supported by the interposed protruding portion 5126, from only an opening on the one surface side exposed from the cutout portion 514. That is, mold material can be injected in one direction. For example, if mold material is injected into the above-described gap between core pieces from two directions, there is the possibility of a weld line being formed at the position where mold material from two directions comes into contact. If a configuration in which mold material is injected into the above-described gap between core pieces in one direction is employed, the above-described weld line is unlikely to be formed, and substantially no degradation in performance is caused by a weld line.

To inject mold material in one direction, it is possible to select the circumferential length of the body portion 512 according to the shape of the interposed protruding portion 5126, for example. Even if the circumferential length of the body portion 512 is short, it is possible to inject mold material in one direction by providing a U-shaped interposed protruding portion 5126 as shown in FIG. 3B, for example, so that only portions, in the circumferential direction, of the inner core piece 31 that are adjacent to each other are open. As in this example, if the interposed protruding portion 5126 is U-shaped and the cutout portion 514 is provided so as to be continuous with the opening, and in addition, if three surfaces of each inner core piece 31 are covered by the body portion 512, it is easier to regulate the direction in which mold material is injected.

The thickness of the body portion 512 can be selected as appropriate, considering, for example, insulation required between the winding portions 2*a* and 2*b* and the magnetic core 3. For example, the thickness of the body portion 512 may be uniform along the entire length of the body portion 512. Alternatively, as in this example, the thickness of the body portion 512 may be partially varied. Specifically, as shown in FIGS. 3B and 3E, the thickness of the corners and the vicinity thereof is larger than the thickness of other portions. Since the body portion 512 includes a thick wall portion and a thin wall portion that has a small thickness, a step-like space G between these portions can be used as a resin path of the resin mold portion 6. The outer circumferential surface of the thin wall portion of the body portion 512 is covered by the resin mold portion 6 (the inner covering portions 61) as indicated by the cutout portion of the coil 2 in FIG. 1 and the two-dot chain line (an imaginary line) in FIG. 3E. Typically, the outer circumferential surface of the thick wall portion is exposed from the resin mold portion 6 (FIG. 1), and is in contact with the inner circumferential surfaces of the winding portions 2*a* and 2*b* (FIG. 3E). The larger the proportion of the thin wall portion in the body portion 512 is (e.g. when only two corners at diagonal positions are thick wall portions), the larger the size of the resin flow path is, and as a result, the contact area between the body portion 512 and the resin mold portion 6 increases. Therefore, although the magnetic core 3 includes a plurality of core pieces and the interposed member 5 includes a plurality of divisional pieces, it is possible to increase the fixing strength of the resin mold portion 6 fixing the magnetic core 3. The larger the proportion of the thick wall portion in the body portion 512 is (e.g. when a portion that covers the entirety of at least one of the three surfaces of the inner core piece 31 is the thick wall portion), the higher the insulation between the coil 2 and the magnetic core 3 is.

The length (hereinafter referred to as "the width") of the body portion 512 in the axial direction of the winding portions 2*a* and 2*b* can be selected as appropriate. The longer the width of the body portion 512 is, the larger the areas of the inner core pieces 31 supported by the body portion 512 are, and as described above, the assembled state is likely to be stable in the manufacturing process. The shorter the width of the body portion 512 is, the longer the interval between intermediate interposed pieces 510 that are adjacent to each other is, the longer the interval between an intermediate interposed piece 510 and an end portion interposed piece 515 that are adjacent to each other is, and the larger the above-described resin flow path is. As a result, it is possible to increase the contact areas between the inner core pieces 31 and the resin mold portion 6. Therefore, it is possible to increase the fixing strength of the resin mold portion 6 fixing the magnetic core 3. Regarding the width of a ring-shaped body portion 517 of the end portion interposed piece 515 described below, see the description regarding the width of the body portion 512. The width of the body portion 512 and the width of the ring-shaped body portion 517 descried below may be set such that the interval between the intermediate interposed pieces 510 and the interval between the intermediate interposed piece 510 and the end portion interposed piece 515 described are predetermined values.

Interposed Protruding Portion

The intermediate interposed piece 510 includes the interposed protruding portion 5126 that stands upright from a surface of the body portion 512 in an orthogonal direction, the surface facing an outer circumferential surface of the inner core piece 31. As shown in FIG. 3C, the interposed protruding portion 5126 is interposed between inner core pieces 31 that are adjacent to each other, to keep the interval between the inner core pieces 31 at a length that corresponds to the thickness of the interposed protruding portion 5126. The interval between the inner core pieces 31 is used as a magnetic gap. Therefore, the thickness of the interposed protruding portion 5126 is set according to a predetermined magnetic gap length.

As shown in FIG. 3B, the interposed protruding portion 5126 in this example is a U-shaped flat plate member that is provided along the entire length, in the circumferential direction, of the U shape of the inner circumferential surface of the body portion 512 (see FIG. 2 also). The inner edge surface of the U-shaped flat plate member is continuous with the inner circumferential surface that defines the cutout portion 514. The shape and location of the interposed protruding portion 5126 may be changed as appropriate. In this example, as described above, the interposed protruding portion 5126 has a shape that matches the shape of the body portion 512 and is one member that is continuous with the body portion 512. However, it is possible to employ, for example, a configuration in which a plurality of interposed protruding portions are arranged at intervals in the circumferential direction of the inner circumferential surface of the body portion 512, or a configuration that is provided with one interposed protruding portion that is only located on a portion of the inner circumferential surface of the body portion 512 in the circumferential direction. Both configurations are provided with an interposed protruding portion that is a segment-shaped portion whose length in the circumferential direction of the body portion 512 is shorter than the circumferential length of the body portion 512. Alternatively, the interposed protruding portion 5126 may be, for example, a rod-shaped member instead of a flat plate member, or in addition to the interposed protruding portion that is segment-shaped.

In a state where the inner core piece 31 and the intermediate interposed piece 510 are assembled, the interposed protruding portion 5126 covers an end surface of the inner core piece 31. Therefore, the larger the proportion of the area covered by the interposed protruding portion 5126 relative to the end surface of the inner core piece 31 is, the larger the area of a portion of the end surface of the inner core piece 31 supported by the interposed protruding portion 5126 is. As a result, it is easier to keep the interval between inner core pieces 31. The smaller the proportion of the above-described area is, the larger the contact area, with a resin gap portion 60, of the end surface of the inner core piece 31 is, in this example. Therefore, it can be expected that the bonding strength of the inner core pieces 31 with the resin gap portions 60 will be improved. To improve the bonding strength, the interposed protruding portion 5126 may be downsized, and areas where the resin gap portions 60 are formed may be enlarged. The proportion of the area not covered by the interposed protruding portion 5126 in the inner core piece 31 may be, for example, greater than or equal to 50%, greater than or equal to 60%, greater than or equal to 70%, or, furthermore, greater than or equal to 80%. The shape of the interposed protruding portion 5126, the protruding height of the interposed protruding portion 5126 from the inner circumferential surface of the body portion 512, the total circumferential length in the circumferential direction of the inner circumferential surface of the body portion 512, the arrangement, and so on may be selected such that the proportion of the above-described area is a predetermined value.

The number of intermediate interposed pieces 510 that are arranged in one of the winding portions 2*a* and 2*b* can be changed as appropriate, and may be one or three or more. If a plurality of intermediate interposed pieces 510 are provided, intermediate interposed pieces 510 that are different from each other in shape, dimensions (e.g. the circumferential length, thickness, and width of the body portion 512, the proportion of the above-described area regarding the interposed protruding portion 5126, etc.), and so on may be provided. If all of the intermediate interposed pieces 510 have the same shape and the same dimensions as in this example, handling is easy when assembling them, which leads to excellent productivity.

End Portion Interposed Piece

As shown in FIGS. 2, 3A, and 3D, the end portion interposed piece 515 in this example is a ring-shaped member as if it was formed by winding a belt member so as to have a square shape with rounded corners, along the outer circumferential surface of the inner core piece 31. In a state where the inner core piece 31 and the end portion interposed piece 515 are assembled, portions (corners in this example) of the inner circumferential surface of the end portion interposed piece 515 are in contact with the inner core piece 31 to support the inner core piece 31, and other portions (portions other than the corners in this example) are not in contact with the inner core piece 31, and gaps g are formed between the end portion interposed piece 515 and the inner core piece 31. Specifically, the end portion interposed piece 515 includes the ring-shaped body portion 517 that surrounds the outer circumferential surface of the inner core piece 31 in the circumferential direction and end portion-side protruding portions 5176 that keep the interval between the end portion interposed piece 515 and the inner circumferential surface of the ring-shaped body portion 517.

Here, as with the intermediate interposed piece 510, the end portion interposed piece 515 may be provided with the cutout portion 514. In addition in this example, when the resin mold portion 6 is formed, mold material is injected from the outer core pieces 32 toward the inner core pieces 31, where substantially, the magnetic core 3 is only covered by the resin mold portion 6, and the coil 2 is not covered by the resin mold portion 6. Therefore, the end portion interposed piece 515 is ring-shaped so that mold material does not leak to the coil 2 side when a mold is filled with mold material from an outer core piece 32 toward an inner core piece 31 via an end surface side of the coil 2. Also, the ring-shaped body portion 517 surrounds the entire circumference of the outer circumferential surface of the inner core piece 31, and substantially no gap is formed between the inner circumferential surfaces of the winding portion 2*a* or 2*b* and the outer circumferential surface of the ring-shaped body portion 517. The thickness of the ring-shaped body portion 517 is adjusted such that the gaps g can be formed between the outer circumferential surface of the inner core piece 31 and the inner circumferential surface of the ring-shaped body portion 517 (FIG. 3D).

The outer circumferential surface of the ring-shaped body portion 517 is constituted by a uniform flat surface (FIGS. 3A and 2), and is substantially in contact with the inner circumferential surface of the winding portion 2*a* or 2*b* (FIG. 3D). The thickness of the inner circumferential surface side portion of the ring-shaped body portion 517 is partially different, and the thickness of the four corners and the vicinity thereof is larger than the thickness of other portions so that there are protruding portions protruding toward the inner circumferential surface side (FIG. 2). These thick wall portions are defined as the end portion-side protruding portions 5176. Steps are formed between the end portion-side protruding portions 5176 and other thin wall portions that are thin (FIGS. 3A and 2). Therefore, as shown in FIG. 3D, in a state where an inner core piece 31 and a ring-shaped body portion 517 are assembled, the gaps g are formed between the end portion-side protruding portions 5176 and the thin wall portions. In this example, four gaps g are formed between the four surfaces of the inner core piece 31 and the thin wall portion.

The thickness of the end portion-side protruding portions 5176 and the thickness of the thin wall portion may be selected as appropriate so that the above-described gaps g (the above-described steps) have a predetermined value. The larger the gaps g are (the larger the thickness of the end portion-side protruding portions 5176 is, or the smaller the thickness of the thin wall portion is), the easier it is to inject mold material, which improves mold material distribution. The smaller the gaps g are (the smaller the thickness of the end portion-side protruding portions 5176 is, or the larger the thickness of the thin wall portion is), the more stably the inner core piece 31 is supported by the end portion-side protruding portions 5176.

The areas where the end portion-side protruding portions 5176 are formed can be selected as appropriate. As in this example, if the end portion-side protruding portions 5176 are provided at the four corners and the vicinity thereof of the ring-shaped body portion 517 that has a rectangular frame shape, the above-described gaps g are large enough to secure satisfactory resin flow paths. For example, it is possible to further increase the resin flow path by employing a configuration in which the end portion-side protruding portions 5176 are provided at only two corners at diagonal positions and the vicinity thereof of the ring-shaped body portion 517. Alternatively, for example, by employing a configuration in which an end portion-side protruding portion 5176 can support one surface of the inner core piece 31, it is possible to increase the contact area with the outer circumferential surface of the inner core piece 31, and support the inner core piece 31 in a stable state.

The end portion interposed piece 515 in this example is further provided with the end surface restriction portions 5178 that cover portions of the surface that faces the outer core pieces 32, of the inner core piece 31 (FIG. 4), and that restrict the inner core piece 31 from moving toward the outer core piece 32. In FIGS. 2 and 3A, differently-shaped plate pieces with rounded corners protrude from the four corners of the ring-shaped body portion 517 toward the inside of the ring-shaped body portion 517, and thus cover the above-described four corners. These plate pieces constitute the end surface restriction portions 5178. The shape and number of the end surface restriction portions 5178, and the proportion of the areas covered by the end surface restriction portions 5178 relative to the end surface of the inner core piece 31 may be selected as appropriate. The larger the proportion of the areas is (e.g. a plate piece that bridges between two corners of the ring-shaped body portion 517 is employed, or the number of end surface restriction portions 5178 is increased), the more possible it is to reliably restrict the inner core piece 31 from moving toward the outer core pieces 32. The smaller the proportion of the above-described area is, the larger the contact area, with a resin gap portion, of the end surface of the inner core piece 31 and the inner end surface 32*e* of the outer core piece 32 are, in this example. It can be expected that the bonding strength of the inner core pieces 31 and the outer core pieces 32 will be improved. To improve the bonding strength, the end surface restriction portions 5178 may be downsized, and areas where the resin gap portions are formed may be enlarged. The proportion of the area of the inner core piece 31 not covered by the end surface restriction portions 5178 may be, for example, greater than or equal to 50%, greater than or equal to 60%, greater than or equal to 70%, or, furthermore, greater than or equal to 80%. If four end surface restriction portions 5178 are provided so as to press the four corners of the inner core piece 31, which is square-shaped as in this example, the proportion of the total area of portions of the inner core piece 31 covered by the end surface restriction portions 5178 is relatively large, and the above-described inner core piece 31 is likely to be restricted from moving. In addition, since a plurality of end surface restriction portions 5178 are provided, the gaps between the end surface restriction portions 5178 can be used as resin flow paths for the resin mold portion 6, and the above-described gap portions can be satisfactorily provided. In this example, the areas of the ring-shaped body portion 517 where the end portion-side protruding portions 5176 are formed and where the end surface restriction portions 5178 are formed match in the circumferential direction. Therefore, in a state where the inner core piece 31 and the end portion interposed piece 515 are assembled, the gaps g are provided (FIG. 3D).

Constituent Materials

Examples of the constituent material of the interposed member 5 include insulative materials such as various kinds of resins. For example, a polyphenylene sulfide (PPS) resin, a polytetrafluoroethylene (PTFE) resin, a liquid crystal polymer (LCP), a polyamide (PA) resin such as nylon 6 or nylon 66, and a thermoplastic resin such as a polybutylene terephthalate (PBT) resin or an acrylonitrile butadiene styrene (ABS) resin may be used. Alternatively, it is possible to use a thermosetting resin such as an unsaturated polyester resin, an epoxy resin, a urethane resin, or a silicone resin. The interposed member 5 can be easily manufactured using a known molding method such as injection molding using the above-described resins.

Resin Mold Portion

The resin mold portion 6 in this example mainly covers portions of the magnetic core 3 not covered by the interposed member 5 as shown in FIG. 1, to hold the plurality of inner core pieces 31 and the outer core pieces 32 as a ring-shaped integrated member. In this example, each set of inner core pieces 31 includes: inner covering portions 61 that cover substantially the entire outer circumferential surfaces, excluding the end surfaces, of the inner core pieces 31 located at the ends of the set; outer covering portions 62 that cover the entire outer circumferential surfaces of the outer core pieces 32, excluding the inner end surfaces 32*e* and the vicinity thereof; resin gap portions 60 that are located between inner core pieces 31 that are adjacent to each other; and resin gap portions (not shown) that are each located between an inner core piece 31 and an outer core piece 32.

Resin Gap Portions

The resin gap portions 60 located between the inner core pieces 31 each have the shape of a rectangular flat plate surrounded by an interposed protruding portion 5126 provided in an intermediate interposed piece 510. The surfaces of the flat plate-shaped resin gap portions 60 are in contact with end surfaces of the inner core pieces 31, and also serve as joining members that join the inner core pieces 31 to each other. A portion of a side surface of a resin gap portion 60 is in contact with the inner edge surface of an interposed protruding portion 5126, and another portion of a side surface on a cutout portion 514 side is continuous with an intermediate covering portion 610 described below. The reactor 1 includes a number of (four in total in this example) resin gap portions 60 corresponding to the number of intermediate interposed pieces 510.

A resin gap portion provided between an inner core piece 31 and an outer core piece 32 is surrounded by an inner surface that defines through holes 52*h* in an outer interposed portion 52, and therefore has the shape of a square flat plate with rounded corners. One surface of this flat plate-shaped resin gap portion is in contact with the end surface of the inner core piece 31 (excluding the area covered by the end surface restriction portion 5178), and another surface is in contact with the inner end surface 32*e* of the outer core piece 32, and thus the resin gap portion also serves as a joining member that joins the inner core piece 31 and the outer core piece 32 to each other. The reactor 1 includes a number of (four in total in this example) such resin gap portions corresponding to the number of through holes 52*h*.

Inner Covering Portions

The inner covering portions 61 mainly cover portions of the outer circumferential surfaces of inner core pieces 31 exposed from the intermediate interposed pieces 510 and from the end portion interposed pieces 515, that is, a gap provided between intermediate interposed pieces 510 that are adjacent to each other, and a gap provided between an intermediate interposed piece 510 and an end portion interposed piece 515. The inner covering portions 61 in this example each further include an intermediate covering portion 610 (FIG. 1) that fills a step between: a portion of an intermediate interposed piece 510 exposed from a cutout portion 514 in the outer circumferential surfaces of inner core pieces 31 that are adjacent to each other; and a body portion 512. Therefore, when the sets of inner core pieces 31 located in the winding portions 2*a* and 2*b* are seen in the axial direction of the winding portions 2*a* and 2*b*, each inner covering portion 61 includes: an entire circumference covering portion that continuously covers the entire outer circumferential surface of a set of inner core pieces 31 (the upper and lower surfaces, and the left and right surfaces);

and a partially covering portion (the intermediate covering portion 610) that only covers a portion of the outer circumferential surface of a set of inner core piece 31 (only the upper surface here). These covering portions are alternatingly arranged, and thus each inner covering portion 61 is formed as one continuous integrated piece overall. Such an intermediate covering portion 610 is continuous with a resin gap portion 60 that is located between inner core pieces 31 that are adjacent to each other. As a result, each inner covering portion 61 also serves as a coupling member that couples the resin gap portions 60 provided between inner core pieces 31 that are adjacent to each other.

Each inner covering portion 61 in this example further includes a portion that covers the outer circumferential surface of the above-described thin wall portion of a body portion 512 (FIG. 1). This portion is continuous with the above-described entire circumference covering portion (FIG. 1). Each inner covering portion 61 in this example also includes end portion covering portions 617 that are interposed between the outer circumferential surface of an inner core piece 31 and the inner circumferential surface of the ring-shaped body portion 517 of an end portion interposed piece 515 (see the two-dotted chain line (imaginary line) in FIG. 3D). In this example, four end portion covering portions 617 that cover the upper and lower surfaces and the left and right surfaces of an inner core piece 31 are provided so as to correspond to four gaps g provided around the inner core piece 31 in the manufacturing process. Such end portion covering portions 617 are continuous with the intermediate covering portion 610 via the above-described entire circumference covering portion.

Outer Covering Portions

The outer covering portions 62 mainly cover portions exposed from the outer interposed portions 52, of the outer circumferential surfaces of the outer core pieces 32. Each outer covering portion 62 in this example includes an extension portion that also covers an outer core side surface of an outer interposed portion 52 so as to close off a core hole 52*f* that is provided in the outer core side surface of the outer interposed portion 52 (FIGS. 1, 4, and 5). The installation surfaces (the lower surfaces) of the extension portions are substantially flush with the installation surfaces of the winding portions 2*a* and 2*b* (FIG. 5), and the surfaces (the upper surfaces) of the extension portions opposite the installation surfaces thereof are located lower than the surfaces (the upper surfaces) of the outer interposed portions 52 opposite the installation surfaces thereof, so that step-like shapes are formed, with the extension portions being located at the lower level (FIG. 1). The side surfaces (the left and right surfaces) of the extension portions are substantially flush with the side surfaces (the left and right surfaces) of the outer interposed portions 52 so as not to protrude from the side surfaces of the outer interposed portions 52 (FIG. 5). The outer covering portions 62 in this example are configured such that, on the extension portions' installation surfaces side, protruding pieces thereof (four pieces in this example) that protrude outward of the outer core pieces 32 serve as attachment portions for fixing the reactor 1 to the installation target. The attachment portions may be omitted.

The inner covering portions 61 and the outer covering portions 62 are continuous via the resin gap portions between the above-described inner core pieces 31 and the outer core pieces 32. That is, the resin mold portion 6 is formed as an integrated member in which the outer covering portions 62, the resin gap portions between the inner core pieces 31 and the outer core pieces 32, the end portion covering portions 617, the portions that cover the gaps between the intermediate interposed pieces 510 and between the intermediate interposed pieces 510 and the end portion interposed pieces 515, the intermediate covering portions 610, and the resin gap portions 60 are continuous.

Constituent Materials

Examples of the constituent resin of the resin mold portion 6 include a PPS resin, a PTFE resin, LCP, a PA resin such as nylon 6, nylon 66, nylon 10T, nylon 9T, or nylon 6T, and a thermoplastic resin such as a PBT resin.

Reactor Manufacturing Method

The reactor 1 provided with the holes 90 can be manufactured by the following reactor manufacturing method according to the first embodiment. In summary, a combined body 10 is housed in a mold, and the resin mold portion 6 is formed. The combined body 10 includes: the above-described coil 2; the magnetic core 3 including the above-described inner core pieces 31 and the outer core pieces 32; and the interposed member 5 interposed between the coil 2 and the magnetic core 3. Specifically, the reactor manufacturing method according to the embodiment employs the interposed member 5 that is provided with the above-described holes 90. Then, the pins 9 that protrude from the inner surface of the mold are inserted into the holes 90, and thus the resin mold portion 6 is formed in a state where portions of the inner end surfaces 32*e* of the outer core pieces 32 are supported.

In this example, when the combined body 10 is housed in the mold as described above, the outer interposed portions 52 partition the space inside the mold so that the core housing spaces serve as mold material filing spaces. The resin mold portion 6 is formed via the filling space, using the resin flow paths formed with the magnetic core 3 and the interposed member 5 as described above. Injection molding or the like may be employed to form the resin mold portion 6.

For the details of the coil 2, the inner core pieces 31, the outer core pieces 32, the interposed member 5, and the resin mold portion 6, see each of the sections above.

Before the resin mold portion 6 is formed, in a state where the outer core pieces 32 and the outer interposed portions 52 are assembled, the holes 90 that are open in the installation surface of the combined body 10 are constituted by the cutouts 329 and the grooves 59. The combined body 10 is placed in the mold such that the installation surface of the combined body 10 is supported by the inner bottom surface of the mold, and the pins 9 protruding from the inner bottom surface are inserted into the holes 90. The pins 9 come into contact with portions of the inner end surfaces 32*e* of the outer core pieces 32 exposed from the holes 90, and thus can support the inner end surfaces 32*e*. By being supported in this way, each of the outer core pieces 32 is restricted from moving toward the other of the pair of outer core pieces 32. Specifically, it is possible to prevent the outer core pieces 32 from moving even when the filling directions of the mold material include a direction toward the coil, and also when the filling pressure is large.

In addition, in this example, when assembling the combined body 10, it is possible to use the end surface restriction portions 5178 of the end portion interposed pieces 515 as stoppers for the inner core pieces 31 to sequentially stack an end portion interposed piece 515, an inner core piece 31, an intermediate interposed piece 510, an inner core piece 31, and an end portion interposed pieces 515.

Also, in this example, in a state where the coil 2, the magnetic core 3, and the interposed member 5 are assembled, continuous spaces, namely the spaces between one surface of each outer core piece 32 and the core holes 52*f* of the outer interposed portions 52, gaps between the end surfaces of the inner core pieces 31 and the inner end surfaces 32*e* of the outer core pieces 32, the gaps g between the inner core pieces 31 and the end portion interposed pieces 515, the gaps between the intermediate interposed pieces 510 and the end portion interposed pieces 515, the gaps $G_{514}$ based on the cutout portions 514 of the intermediate interposed pieces 510, and the gaps between the intermediate interposed pieces 510, are used as mold material resin flow paths, as described above. The step-like spaces G between the thick wall portions and the thin wall portions of the intermediate interposed pieces 510 are also used as resin flow paths.

In this example, in a state where the end portion interposed pieces 515 and the intermediate interposed pieces 510 are attached to the inner core pieces 31, the ring-shaped body portions 517 of the end portion interposed pieces 515 are provided so as to overlap the step-like spaces G. As a result, three gaps g that are provided in three surfaces (the lower surface and the left and right surfaces) of each inner core piece 31 from among the four gaps g are not in communication with three step-like spaces G. The remaining one gap g (the upper gap g) provided in one surface (the upper surface) of each inner core piece 31 is in communication with the gaps $G_{514}$. Therefore, it is possible to inject mold material from the upper gaps g to the gaps $G_{514}$ of the cutout portions 514 of the intermediate interposed pieces 510 via one surface (the upper surface) of each inner core piece 31. As a result, as described above, it is possible to limit the direction in which mold material is injected to inner core pieces 31 that are adjacent to each other, to one direction.

Effects

With the reactor 1 according to the first embodiment and the reactor manufacturing method according to the first embodiment, when forming the resin mold portion 6, it is possible to insert the pins 9 that protrude from the inner surface of a mold, into the holes 90 to directly support portions of the inner end surfaces 32*e* of the outer core pieces 32 using the pins 9. Therefore, the outer core pieces 32 are unlikely to be displaced relative to the mold.

Specifically, the filling pressure of the mold material may be increased in the following cases.

(1) A case where the core housing spaces are relatively narrow due to the internal space of the mold being partitioned by the outer interposed portions 52.

(2) A case where narrow gaps that are defined by the inner core pieces 31, the outer core pieces 32, and the interposed member 5 (e.g. the gaps g) are to be filled with mold material in a relatively short time.

(3) A case where spaces between core pieces that are adjacent to one another are also filled with mold material in order to form the resin gap portions 60.

Even in these cases, with the reactor 1 according to the first embodiment and the reactor manufacturing method according to the first embodiment, it is possible to prevent the outer core pieces 32 from being displaced, due to the pins 9 being inserted into the holes 90. In particular, if the mold material filled in the mold presses each outer core piece 32 toward the other outer core piece 32 (in directions toward the coil), the pins 9 support the outer core pieces 32 against this pressure. Therefore, it is possible to prevent intervals between the areas where the resin gap portions 60 are formed, from being changed due to the outer core pieces 32, which are pressed against by mold material, pressing the inner core pieces 31, before the resin gap portions 60 are formed. In this example, the holes 90 are constituted by both of the cutouts 329 of the outer core pieces 32 and the grooves 59 of the outer interposed portions 52. Therefore, as shown in FIG. 2, it is possible to use pins 9 that each have a relatively large cross-sectional area, which also results in the outer core pieces 32 being firmly fixed. Therefore, it is easier to keep the length from one outer core piece 32 to the other outer core piece 32 at a predetermined length, and furthermore, it is easier to keep the intervals between the inner core pieces 31, and thus it is possible to form the resin gap portions 60 with high accuracy. Also, since the resin gap portions 60 are provided, it is possible to more reliably keep the intervals between the inner core pieces 31, and prevent inductance from fluctuating. Therefore, the reactor 1 can keep a predetermined inductance over a long time. In particular, as the intermediate interposed pieces 510 have a specific shape as in this example, it is possible to restrict the direction in which mold material is injected to the gaps between the inner core pieces 31. As a result, it is possible to appropriately form the resin gap portions 60, and thus the reactor 1 can keep a predetermined inductance.

Also, with the reactor 1 according to the first embodiment and the reactor manufacturing method according to the first embodiment, the pins 9 are inserted into the holes 90. Therefore, it is easier to position the outer core pieces 32 and the outer interposed portions 52 in the mold, and, furthermore, to position the coil 2 and position the inner core pieces 31. Therefore, productivity is excellent. The productivity of the reactor 1 in this example is excellent from the following viewpoints as well.

(1) Due to the resin gap portions 60 being provided, it is possible to omit gap plates and the step of joining core pieces and gap plates.

(2) It is easier to assemble the inner interposed portions 51 (the intermediate interposed pieces 510) provided with the interposed protruding portions 5126 and the inner core pieces 31.

(3) It is possible to form the resin mold portion 6 and the resin gap portions 60 at the same time.

Furthermore, for the following reasons, resin flow paths can be satisfactorily secured around the inner core pieces 31, which improves the distribution of mold material that is the material of the resin mold portion 6, and the productivity of the reactor 1 in this example is excellent from this viewpoint as well.

(4) The intermediate interposed pieces 510 and the end portion interposed pieces 515 provided in each of the winding portions 2*a* and 2*b* are separated from each other in the axial direction of the winding portions 2*a* and 2*b*.

(5) The intermediate interposed pieces 510 are provided with cutout portions 514 and the thin wall portions, and thus gaps $G_{514}$ and the step-like spaces G can be formed.

(6) The end portion interposed pieces 515 are provided with the end portion-side protruding portions 5176, and the gaps g can be formed between the end portions interposed pieces 515 and the inner core pieces 31.

The resin gap portions 60 included in the resin mold portion 6 join the inner core pieces 31 with each other, and the inner core pieces 31 and the outer core pieces 32. Also, in this example, for the reason (4) above, sufficiently large areas of the inner core pieces 31 are covered by the resin mold portion 6. Therefore, the mechanical strength of the reactor 1, into which the magnetic core 3 is integrated, is improved by the resin mold portion 6. Furthermore, due to the resin mold portion 6 being provided, it can be expected that the reactor 1 will be protected from external factors (especially, corrosion protection for the outer core pieces 32, for example), vibrations and noise will be prevented from occurring, insulation will be improved, and, depending on the constituent material, heat dissipation properties will be improved, for example.

In addition, the reactor 1 in this example achieves the following effects.

(1) Since the peripheral portions of the outer interposed portions 52 are thick, even if the filling pressure of mold material increases, the coil 2 and so on can be prevented from being damaged due to this pressing force. Even if the resin flow paths are narrow, it is possible to complete filling in a short time by increasing the filling pressure, and thus productivity is excellent.

(2) Since the end portions of the winding wires 2*w* are drawn out upward away from the winding portions 2*a* and 2*b*, and the outer interposed portions 52 are provided with the fitting grooves, the recessed portions 520, and the draw-out grooves, the coil 2 and the outer interposed portions 52 can be in intimate contact with each other. With such outer interposed portions 52, it is easier to hold the winding portions 2*a* and 2*b* such that there are no gaps between the turns of the winding portions 2*a* and 2*b*, and it is possible to realize a downsized reactor 1.

(3) Since the inner end surfaces 32*e* of the outer core pieces 32 and the end surfaces of the inner core pieces 31 are uniform flat surfaces, and the central portion of each outer interposed portion 52 is interposed between an outer core piece 32 and an inner core piece 31, resin gap portions with a uniform thickness can be provided between the outer core pieces 32 and the inner core pieces 31.

(4) As described above, the coil 2 and the outer interposed portions 52 can be in intimate contact with each other, and the mold material injected from each outer core piece 32 side is unlikely to leak toward the coil 2. Therefore, it is easier to manufacture a reactor 1 in which only the magnetic core 3 is covered by the resin mold portion 6 and the coil 2 is exposed to the outside.

(5) Since the coil 2 is exposed to the outside without being covered by the resin mold portion 6, when performing cooling using a liquid refrigerant or cooling using a fan, the coil 2 can come into direct contact with the liquid refrigerant or the convective gas, which leads to excellent heat dissipation properties.

In addition, the reactor 1 according to the first embodiment may be provided with at least one of the following: (1) sensors (not shown) for measuring physical amounts regarding the reactor 1, such as a temperature sensor, a current sensor, a voltage sensor, a magnetic flux sensor, and so on; (2) a heat dissipation plate (such as a metal plate) that is attached to at least a portion (such as the installation surface) of the outer circumferential surface of the coil 2; and (3) a bonding layer (e.g. an adhesive layer, preferably with excellent insulative properties) that is interposed between the installation surface of the reactor 1 and the installation target or the heat dissipation plate described in (2).

Uses

The reactor 1 according to the first embodiment can be used in a preferable manner in various converters such as an on-board converter (typically a DC-DC converter) that is mounted on a vehicle such as a hybrid vehicle, a plug-in hybrid vehicle, an electric vehicle, or a fuel cell vehicle, and a converter for an air conditioner, and in constituent components of a power conversion device. The reactor manufacturing method according to the embodiment is applicable to the manufacturing of the reactor 1 or the like.

Modifications

At least one of following modifications is applicable to the above-described first embodiment.

(1) The cutouts 329 of the outer core pieces 32 are omitted, and the areas where the holes 90 are formed are constituted by the grooves 59 and portions of the flat inner end surfaces 32*e* of the outer core pieces 32.

If this is the case, it is easier to prevent the outer core pieces 32 from being displaced, by using outer circumferential surface side pins that support the outer circumferential surfaces of the outer core pieces 32. For example, if the left and right side surfaces of the outer core pieces 32 are to be supported, the outer circumferential surface pins may be provided so as to protrude in the direction in which the winding portions 2*a* and 2*b* are arranged side by side, and sandwich the left and right side surfaces.

(2) The cutouts 329 of the outer core pieces 32 are omitted, the inner circumferential surfaces of the holes 90 are only constituted by the outer interposed portions 52, and the bottom surfaces of the holes 90 are constituted by portions of the flat inner end surfaces 32*e* of the outer core pieces 32.

If this is the case, the outer interposed portions 52 may be provided with through holes (not shown) that penetrate from the installation surfaces to the outer core side surfaces. Even in this case, the outer circumferential surface side pins can be used in combination.

(3) One of the pair of outer interposed portions 52 is not provided with the through holes 52*h*, and has a flat plate shape.

If this is the case, a portion of the flat plate-shaped outer interposed portion between an inner core piece 31 and an outer core piece 32 serves as a magnetic gap.

(4) The inner interposed portions 51 are not provided with the interposed protruding portions 5126, and are not provided with the resin gap portions 60.

If this is the case, gap plates that are made of a material that has a lower magnetic permeability than that of core pieces may be provided. Examples of the above-described material include a non-magnetic material such as resin or alumina, and a composite material that includes a non-magnetic material and a magnetic material.

(5) The inner interposed portions 51 are divided pieces that are divided in a direction (in a top-bottom direction or a left-right direction here) that is orthogonal to the axial direction of the winding portions 2*a* and 2*b*.

(6) The coil 2 provided with the pair of winding portions 2*a* and 2*b* is formed using one continuous winding wire 2*w*.

If this is the case, the coil 2 has a coupling portion that couples the winding portions 2*a* and 2*b* to each other. This coupling portion can be sufficiently distant from the turns of the winding portions 2*a* and 2*b* (e.g. the coupling portion is lifted up in FIG. 1) so that the coil 2 and the outer interposed portions 52 are likely to come into intimate contact as described above.

(7) The coil 2 includes only one winding portion, and the magnetic core 3 has a well-known shape, such as the shape of a so-called EE core, ER core, or EI core.

(8) The winding wire 2*w* is a coated round wire that includes a round wire conductor and an insulative coating.

(9) The winding portions of the coil 2 are cylindrical members whose end surfaces have a ring-like cylindrical shape, or members whose end surfaces have an elliptical shape, a race track shape, a square shape, or another polygonal shape, for example.

(10) The magnetic core 3 includes, as core pieces, U-shaped members that include portions that are located inside the winding portions 2*a* and 2*b* and portions that are located outside the winding portions 2*a* and 2*b*.

The present application is not limited to these examples, and is specified by the scope of claims. All changes that come within the meaning and range of equivalency of the claims are intended to be embraced therein.

LIST OF REFERENCE NUMERALS

1: Reactor
10: Combined Body
2: Coil
2*a*, 2*b*: Winding Portion
2*w*: Winding Wire
3: Magnetic Core
31: Inner Core Piece
32: Outer Core Piece
32*e*: Inner End Surface
329: Cutout
5: Interposed Member
51: Inner Interposed Portion
52: Outer Interposed Portion
59: Groove
510: Intermediate Interposed Piece
512: Body Portion
5126: Interposed Protruding Portion
514: Cutout Portion
515: End Portion Interposed Piece
517: Ring-shaped Body Portion
5176: End Portion-side Protruding Portion
5178: End Surface Restriction Portion
52*h*: Through Hole
52*f*: Core Hole
520: Recessed Portion
522: Protruding Portion
523: Support Surface
6: Resin Mold Portion
60: Resin Gap Portion
61: Inner Covering Portion
62: Outer Covering Portion
610: Intermediate Covering Portion
617: End Portion Covering Portion
9: Pin
90: Hole
g, $G_{514}$: Gap
G: Step-like Space

The invention claimed is:

1. A reactor comprising:

a coil that includes a winding portion;

a magnetic core that includes a plurality of core pieces that are located inside and outside the winding portion;

an interposed member that is interposed between the coil and the magnetic core; and a resin mold portion that includes an outer covering portion that covers at least a portion of an outer core piece of the magnetic core, the outer core piece being located outside the winding portion, wherein the interposed member includes an outer interposed portion that is interposed between an end surface of the winding portion and an inner end surface of the outer core piece, and the outer interposed portion has a hole on the outer core piece side, through which a portion of the inner end surface of the outer core piece is exposed from the resin mold portion.

2. The reactor according to claim 1, wherein the magnetic core includes an inner core piece that is located inside the winding portion, and at least one gap portion that is interposed between core pieces that are adjacent to each other, the outer interposed member has a through hole that penetrates through a winding portion side surface thereof and an outer core piece side surface thereof so that an end surface of the inner core piece is exposed from the hole, the interposed member includes an inner interposed portion that is interposed between an inner circumferential surface of the winding portion and an outer circumferential surface of the magnetic core, and that is provided with an interposed protruding portion that keeps an interval between core pieces that are adjacent to each other, and the resin mold portion includes an inner covering portion that is continuous with the outer covering portion and covers at least a portion of the inner core piece, and a resin gap portion that constitutes the gap portion.

3. The reactor according to claim 1, wherein the inner end surface of the outer core piece is provided with a cutout that constitutes a portion of an internal space of the hole.

4. The reactor according to claim 1, wherein the end surface of the winding portion is provided with an inner circumference side area that bulges in an axial direction of the winding portion, relative to an outer circumference side area of the end surface of the winding portion, and a surface of the outer interposed portion, the surface facing the end surface of the winding portion, is provided with a recessed portion into which the inner circumference side area is fitted.

5. A reactor manufacturing method comprising:

a step of putting a combined body into a mold, and forming a resin mold portion, the combined body including: a coil that includes a winding portion; a magnetic core that includes a plurality of core pieces that are located inside and outside the winding portion; and an interposed member that is interposed between the coil and the magnetic core, and the resin mold portion covering at least a portion of an outer core piece of the magnetic core, the outer core piece being located outside the winding portion, wherein the interposed member includes an outer interposed portion that is interposed between an end surface of the winding portion and an inner end surface of the outer core piece, and the outer interposed portion has a hole on the outer core piece side, through which a portion of the inner end surface of the outer core piece is exposed, and the resin mold portion is formed in a state where a pin that protrudes from an inner surface of the mold is inserted into the hole so that a portion of the inner end surface is supported.

* * * * *